US007355560B2

(12) United States Patent
Nagai

(10) Patent No.: US 7,355,560 B2
(45) Date of Patent: Apr. 8, 2008

(54) DIELECTRIC LENS, DIELECTRIC LENS DEVICE, DESIGN METHOD OF DIELECTRIC LENS, MANUFACTURING METHOD AND TRANSCEIVING EQUIPMENT OF DIELECTRIC LENS

(75) Inventor: Tomohiro Nagai, Kyoto-Fu (JP)

(73) Assignee: Murata Manufacturing Co., Ltd. (JP)

( * ) Notice: Subject to any disclaimer, the term of this patent is extended or adjusted under 35 U.S.C. 154(b) by 50 days.

(21) Appl. No.: 11/385,658

(22) Filed: Mar. 22, 2006

(65) Prior Publication Data

US 2006/0202909 A1 Sep. 14, 2006

Related U.S. Application Data

(63) Continuation of application No. PCT/JP2004/008345, filed on Jun. 15, 2004.

(30) Foreign Application Priority Data

Oct. 3, 2003 (JP) ..... 2003-345861

(51) Int. Cl.
*H01Q 15/08* (2006.01)

(52) U.S. Cl. ..... 343/911 R

(58) Field of Classification Search ..... 343/910, 343/911 R; 359/728, 726, 718
See application file for complete search history.

(56) References Cited

U.S. PATENT DOCUMENTS 4,769,646 A 9/1988 Raber et al.
5,526,190 A * 6/1996 Hubble et al. ..... 359/719
5,757,557 A * 5/1998 Medvedev et al. ..... 359/708
5,982,541 A * 11/1999 Li et al. ..... 359/497
6,639,733 B2 * 10/2003 Minano et al. ..... 359/728

(Continued)

FOREIGN PATENT DOCUMENTS

JP 54-132156 A 10/1979

(Continued)

OTHER PUBLICATIONS

A.R. Dion; Abroadband Compound Waveguide Lens; IEEE Transactions on Antennas and Propagation, pp. 751-755, vol. AP-26, No. 5, Sep. 1978.

(Continued)

*Primary Examiner*—Huedung Mancuso
(74) *Attorney, Agent, or Firm*—Dickstein, Shapiro, LLP.

(57) ABSTRACT

A design process first determines a desired aperture distribution, then converts the electric power conservation law, Snell's law on the rear face side of a dielectric lens, and the formula representing light-path-length constraint, into simultaneous equations, and computes the shapes of the surface and rear face of the dielectric lens depending on the azimuthal angle θ of a primary ray from the focal point of the dielectric lens to the rear face of the dielectric lens, and then reduces the light path length in the formula showing light-path-length constraint by an integral multiple of the wavelength when the coordinates on the surface of the dielectric lens reach a predetermined restriction thickness position. A dielectric lens is designed by sequentially changing the lazimuthal angle θ from its initial value, and also repeating the second and third steps. Thus, downsizing and quantification is realized by zoning while keeping antenna properties at the time of constituting a dielectric lens antenna in a good condition.

20 Claims, 23 Drawing Sheets

U.S. PATENT DOCUMENTS

2003/0016539 A1* 1/2003 Minano et al. ..... 362/347

FOREIGN PATENT DOCUMENTS

| | | | |
|---|---|---|---|
| JP | 56-144927 | A | 11/1981 |
| JP | 03-080704 | A | 4/1991 |
| JP | 06-252634 | A | 9/1994 |
| JP | 07-086827 | A | 3/1995 |
| JP | 9-223924 | | 8/1997 |
| JP | 2002-515213 | A | 5/2002 |

OTHER PUBLICATIONS

Dielectric Lens Shaping and Coma-Correction Zoning, Part I: Analysis: IEEE Transactions on antenna and propagation, pp. 221, vol. AP-31, No. 1, Jan. 1983.
International Search Report, Aug. 2004.
International Written Opinion, no date.
Antenna engineering handbook 2nd edition, McGraw-Hill, 1984.

* cited by examiner

PRIOR ART

PRIOR ART

DIELECTRIC LENS, DIELECTRIC LENS DEVICE, DESIGN METHOD OF DIELECTRIC LENS, MANUFACTURING METHOD AND TRANSCEIVING EQUIPMENT OF DIELECTRIC LENS

This is a continuation of PCT/JP2004/008345, filed on 06/15/2004.

TECHNICAL FIELD

The present invention relates to a dielectric lens used in a dielectric lens antenna in a microwave band or millimeter wave band, a dielectric lens device, a design method of a dielectric lens, a manufacturing method of a dielectric lens and transceiving equipment which uses a dielectric lens or a dielectric lens device.

BACKGROUND ART

A dielectric lens antenna used in a microwave or millimeter wave band is for refracting an electromagnetic wave which radiates widely from a primary radiator well, aligning the phase thereof on a virtual aperture face ahead of a lens, and also creating an electromagnetic field amplitude distribution on the aperture face thereof. Thus, the electric wave can be made to emit sharply in a certain direction. This dielectric lens antenna resembles a lens used for optics, but the greatest difference is that it is necessary not only to simply align the phase but also to create an amplitude distribution (aperture distribution). This is because antenna properties (directivity) at a distant place have a property represented with the Fourier transform of amplitude distribution, and in order to obtain desired directivity, it is necessary to adjust an aperture distribution well.

Accordingly, it is important with a dielectric antenna, to align the phase of electromagnetic waves over the aperture face, and to create a desired aperture distribution as well.

In order to align the phase over the aperture face, the properties of light rays are utilized wherein even if the distance (light path length) over which the light ray emitted travels, from the primary radiator to the aperture face, changes by an integral multiple of the wavelength, the respective light rays reinforce each other, whereby the shape of the lens can be cut off. This is called zoning. The Fresnel lens, well known for the field of optics, is also based on the same concept as this, but in the case of optics, there is no concept of an aperture distribution.

A dielectric lens antenna comprises a primary radiator such as a horn antenna, and a dielectric lens. In general, the dielectric lens portion of the dielectric lens antenna is high in both weight and volume and in order to reduce the size and weight of the overall equipment, a reduction in the size and weight of the dielectric lens has been desired. As for a method for making a dielectric lens thinner and lighter, the above zoning technique can be employed.

For example, a technique has been disclosed in J. J. Lee, "Dielectric Lens Shaping and Coma-Correction Zoning, Part I: Analysis", IEEE Transactions on antenna and propagation, pp. 221, vol, AP-31, No. 1, Jan. 1983, (Non-Patent Document 1) wherein an aperture distribution is designed beforehand, following which the rear face side is subjected to zoning, thereby making the aperture distribution after zoning generally equal to that before zoning. FIG. 1 illustrates an example of a dielectric lens which was subjected to zoning. In this drawing, the left side is the side facing a primary radiator (rear face side), and the right side is the side opposite to the primary radiator (surface side).

FIG. 2 is a flowchart illustrating the design method of a dielectric lens of Non-Patent Document 1. First, a desired aperture distribution is determined (S11). Then the center position of the lens, serving as the start point of computations is determined (S12). Subsequently, the solutions of the electric power conservation law, Snell's law regarding a surface (front face), and the formula showing light-path-length constraint, are obtained using numerical computations (S13). Computations are performed for up to the circumferential edges of the lens, to complete the computations of lens shapes which have not been subjected to zoning (S14). Then, the light path length is changed by wavelength at a suitable rear face position along the primary ray, and the rear face shape of the dielectric lens is primarily changed (zoned) (S15). The entire dielectric lens is subjected to this processing of step 15 (S16→S15→and so on).

Also, a technique has been disclosed in Japanese Unexamined Patent Application Publication No. 9-223924 (Patent Document 1) wherein, in order to suppress loss due to refraction caused by zoning, the surface side is made to be a convex shape, and the rear face side is subjected to zoning. FIG. 3 is a cross-sectional view illustrating an example thereof. A dielectric lens 10 forms a recessed portion 2 due to zoning on the rear face side of a dielectric portion 1 (side facing a primary radiator 20).

Also, Richard C. Johnson and Henry Jasik, "Antenna engineering handbook 2nd edition", McGraw-Hill (1984), (Non-Patent Document 2), a zoning technique for a dielectric lens which had been known by that time in 1984 is described. For example, FIG. 4A is an example wherein the surface side of a dielectric lens has been taken as a plane, with the convex shape on the rear face side subjected to zoning. FIG. 4B is an example wherein the rear face side has been taken as a convex shape, with the plane on the surface side subjected to zoning. Further, FIG. 4C is an example wherein the rear face side has been taken as a plane, with the convex shape on the surface side subjected to zoning.

DISCLOSURE OF INVENTION

In order to improve antenna properties, it is important to optimize aperture distribution. The aperture distribution in the Lee article was made equal with the lens before optimized zoning and the lens after zoning, and mainly the lens rear side was subjected to zoning. Although reduction in weight was realized, a reduction in thickness could not be realized with lenses in which the surface side was convex.

Also, when attempting to reduce the thickness of a lens in which the surface side has a convex shape by subjecting the surface side thereof to zoning, the conventional techniques simply cut off the front side, such as with the Fresnel lens serving as an optical lens, or as shown in FIG. 4C, so there is a problem that the aperture distribution changes before and after zoning.

Also, when subjecting the front side of a lens to zoning, a disorder in the magnetic field results due to diffraction effects, and the antenna properties deteriorate if the lens is cut off perpendicularly simply like the Fresnel lens serving as an optical lens, or if there is no clear guideline as shown in FIG. 4C and the lens is cut off to an imprecise size.

In Japanese Unexamined Patent Application Publication No. 9-223924, the lens shape is changed along with the primary ray, and in this case, loss due to refraction can be prevented, but this creates a sharpened portion on the dielectric lens, so diffraction at this portion newly occurs.

Choosing zoning positions is performed in many cases simply at equal intervals, or conditions for removal of coma aberration such as shown in Non-Patent Document 1, but in this case, the influence of disturbance in the magnetic field caused by diffraction effects is not taken into consideration at all.

Also, a recessed portion like a sheer valley occurs with the dielectric lens subjected to the conventional zoning, between a stepped face and a refraction face, and dust, rain, and snow readily adhere to or collect in this recessed portion. Since rain or snow, or dust containing moisture has a high dielectric constant, a problem of antenna properties deteriorating greatly is caused by their collecting in the recessed portion.

It is an object of the present invention to provide a dielectric lens device, a design method of a dielectric lens, a manufacturing method of a dielectric lens, and transceiving equipment using a dielectric lens or dielectric lens device, which eliminate the above various problems, suitably maintain antenna properties in a configuration of a dielectric lens antenna, reduce the size and weight of dielectric lenses by zoning, and eliminate the problem of adhesion of dust, rain, and snow.

In order to achieve the above object, the present invention is configured as follows.

(1) A design method of a dielectric lens according to the present invention is characterized in that the design method comprises: a first step of determining a desired aperture distribution; a second step of converting Snell's law at the rear face facing the first primary radiator side of a dielectric lens, the electric power conservation law, and the formula representing light-path-length constraint, into simultaneous equations, and computing the shapes of the surface which is the front side opposite to the primary radiator and the above rear face depending on the azimuthal angle θ of a primary ray from the focal point of the dielectric lens to the rear face of the dielectric lens; and a third step of reducing the light path length in the above formula representing light-path-length constraint only by the integral multiple of the wavelength in the air when the coordinates on the surface of the dielectric lens reach a predetermined restriction thickness position; wherein the above azimuthal angle θ of a primary ray is changed from its initial value, and also the second step and the third step are repeated.

According to this design method of a dielectric lens, the surface and rear face of the dielectric lens is obtained by directly computing these while storing the aperture distribution, so a desired aperture distribution can be stored strictly, thereby obtaining desired properties of a dielectric lens antenna.

Note that waves to be conveyed with the dielectric lens of the present invention are, for example, electromagnetic waves in a millimeter wave band, but the refraction actions at the dielectric lens can be handled in the same way as light which are electromagnetic waves having a short wavelength, and accordingly, in this application, the axis which passes along the center of a dielectric lens in that direction of the right back is called an "optical axis", the electromagnetic waves which go straight on in a predetermined direction are called a "primary ray", and the propagation course of electromagnetic waves is called a "light path."

(2) Also, the design method of a dielectric lens according to the present invention is characterized in that the design method further comprises a fourth step for correcting the inclination angle of the stepped face occurring on the surface which is the front side (opposite to the primary radiator) of the dielectric lens by reducing the above light path length only by an integral multiple of the wavelength such that the above stepped face inclines toward the focal direction rather than the thickness direction of the dielectric lens, following which the second step and the third step are repeated until the above azimuthal angle θ reaches a final value.

(3) Also, the design method of a dielectric lens according to the present invention is characterized in that the angle which the above stepped face forms as to the primary ray of electromagnetic waves which enters into an arbitrary position of the rear face of the dielectric lens from the above focal point, is refracted and progresses within the dielectric lens, is taken as an angle within the limits of ±20°.

According to this design method of a dielectric lens, by correcting the inclination angle of the stepped face occurring on the surface of the dielectric lens by reducing the above light path length only by the integral multiple of the wavelength such that the above stepped face inclines toward the focal direction rather than the thickness direction of the dielectric lens, and particularly by taking the angle which the stepped face forms as to the primary ray of electromagnetic waves which progresses within the dielectric lens as being within the limits of ±20°, disorder of the magnetic field is suppressed, thereby preventing side lobe due to diffraction from occurring. Further, since the angle of the edge portion of the stepped face becomes more gentle, manufacturing is easier.

(4) Also, with the design method of a dielectric lens according to the present invention, the initial value of the above azimuthal angle θ is taken as the angle which the primary ray forms from the focal point to the surrounding end positions of the dielectric lens, and the final value of the above azimuthal angle θ is taken as the angle which the primary ray forms from the focal point to the optical axis of the dielectric lens.

According to this design method of a dielectric lens, the accumulation of errors relating to computations becomes small, and a highly precise shape of a dielectric lens can be designed. Supposing that computations proceed toward the surrounding-edge direction from the center of a dielectric lens, a problem will arise at a portion where the crossing angle of the back-and-front surfaces of the lens and the primary ray is close to perpendicular, like the lens central portion, wherein the end portions of the surface and rear face of the lens finally do not cross at one point at the marginal end portion, when just a few errors are accumulated. Also, since the thickness of the dielectric lens from the circumferential edge position of the dielectric lens can be computed as 0, so operations for changing the light path length whenever the thickness of the lens becomes a predetermined thickness by changing the azimuthal angle θ can be readily performed.

(5) Also, a manufacturing method of a dielectric lens of the present invention is characterized in that the manufacturing method comprises: a process for designing the shape of a dielectric lens using any one of the above design methods; a process for preparing an injection-molding mold; and a process for injecting resin in the above injection-molding mold to create a dielectric lens with the resin.

(6) Also, a dielectric lens according to the present invention is characterized in that its principal portion forms a rotationally symmetrical member with the optical axis as a rotation center, and the surface which is the front side (opposite to a primary radiator) comprises: multiple front-side refraction faces which protrude in the direction of the surface; and a stepped face which connects between the adjoining front-side refraction faces; wherein the stepped face forms an angle of ±20° to the primary ray which enters into an arbitrary position of the rear face (facing the above primary radiator) from a focal point, and progresses within the dielectric lens, and a curved face by zoning is provided in the position in the rear face of the primary ray passing through the front-side refraction face.

(7) Also, the dielectric lens according to the present invention is characterized in that the curved face by zoning between the front-side refraction face and the rear face is a curved face obtained by Snell's law regarding the rear face, light-path-length conditions, and the electric power conservation law which provides a desired aperture distribution.

(8) Also, a dielectric lens device according to the present invention is characterized in that the above dielectric lens has a radome which is formed on the surface of the dielectric lens so as to fill the recessed portion formed by the front-side refraction face and the stepped face, and has a dielectric constant lower than that of the dielectric lens.

According to such a configuration, dust, rain, and snow do not collect in the recessed portion formed by the front-side refraction face and the stepped face, thereby preventing antenna properties from deterioration. Also, the characteristic deterioration by providing the radome can be prevented.

(9) Also, the dielectric lens device according to the present invention is characterized in that when representing the specific inductive capacity of the above radome as $\epsilon 2$, and representing the specific inductive capacity of the above dielectric lens as $\epsilon 1$ respectively, $\epsilon 2 \ldots (\epsilon 1)$ is satisfied.

(10) Also, the dielectric lens device according to the present invention is characterized in that the surface of the above radome has a shape which connects multiple curved faces at a distance from the surface of the dielectric lens by $\lambda/4+n\lambda$ (wherein n is an integer equal to or greater than 0, and $\lambda$ is a wavelength).

According to such a configuration, the reflective properties of the dielectric lens device surface can be made low.

(11) Also, transceiving equipment comprises: the above dielectric lens and a primary radiator.

Thus, small lightweight transceiving equipment, for example, such as a millimeter-wave radar, can be configured.

BRIEF DESCRIPTION OF THE DRAWINGS

FIGS. 19A and 19B are diagrams illustrating the configuration of a dielectric lens antenna according to an eighth embodiment.

BEST MODE FOR CARRYING OUT THE INVENTION

Description will be made regarding a dielectric lens, design method and manufacturing method thereof according to a first embodiment with reference to FIG. 5A through FIG. 9.

Figure 5A:
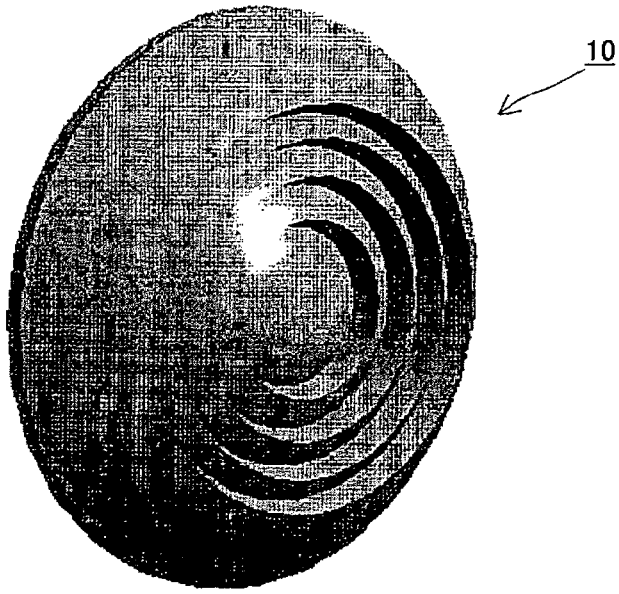
FIGS. 5A and 5B are diagrams illustrating the configuration of a dielectric lens according to a first embodiment.
Figure 5B:
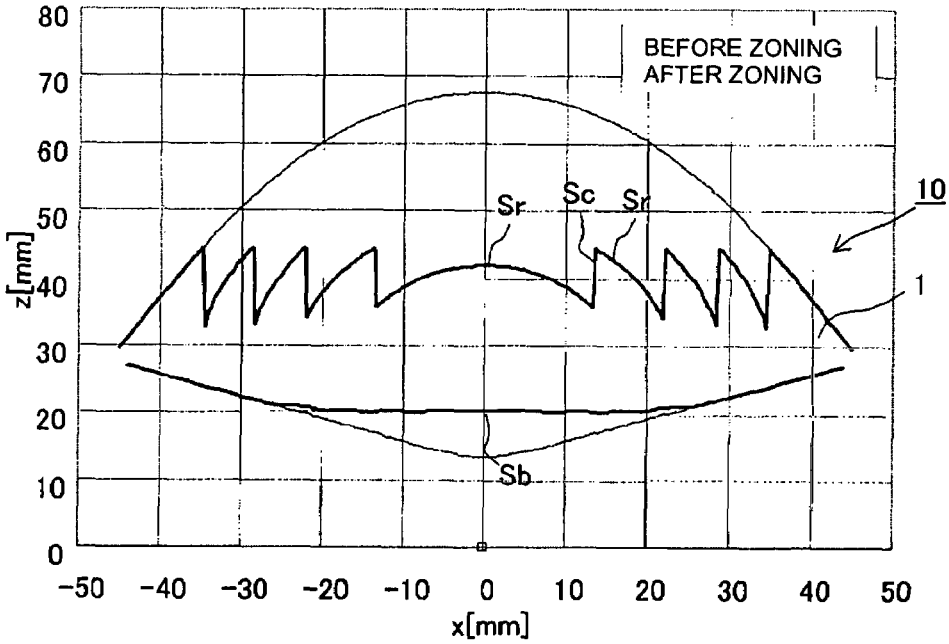

FIG. 5A is an external perspective view of a dielectric lens, and FIG. 5B is a cross-sectional view at a face including the optical axis thereof. Now, let us say that the z axis is taken as the optic-axis direction, the x axis is taken as the radial direction, where the positive direction of z is the surface direction of the dielectric lens, and the negative direction of z is taken as the rear-face direction of the dielectric lens. The rear-face side of this dielectric lens 10 is the side facing a primary radiator. The dielectric portion 1 of the dielectric lens 10 consists of a uniform substance with a greater specific inductive capacity than the ambient medium (air) through which electromagnetic waves are propagated. The surface of the dielectric lens 10 comprises front-side refraction faces Sr, and stepped faces Sc which connect between the mutually adjoining front-side refraction faces Sr. The rear face Sb of the dielectric lens 10 forms a shape which connects the same number of curved faces as the number of the front-side refraction faces Sr according to front-side zoning. Note that the thin line in FIG. 5B represents the shape (before zoning) in the case of not performing zoning. Thus, reduction in thickness and reduction in weight can be attained overall by subjecting the surface side of the dielectric lens 10 to zoning (make the front-side refraction faces into a shape continuously connected with the stepped face).

Figure 6:
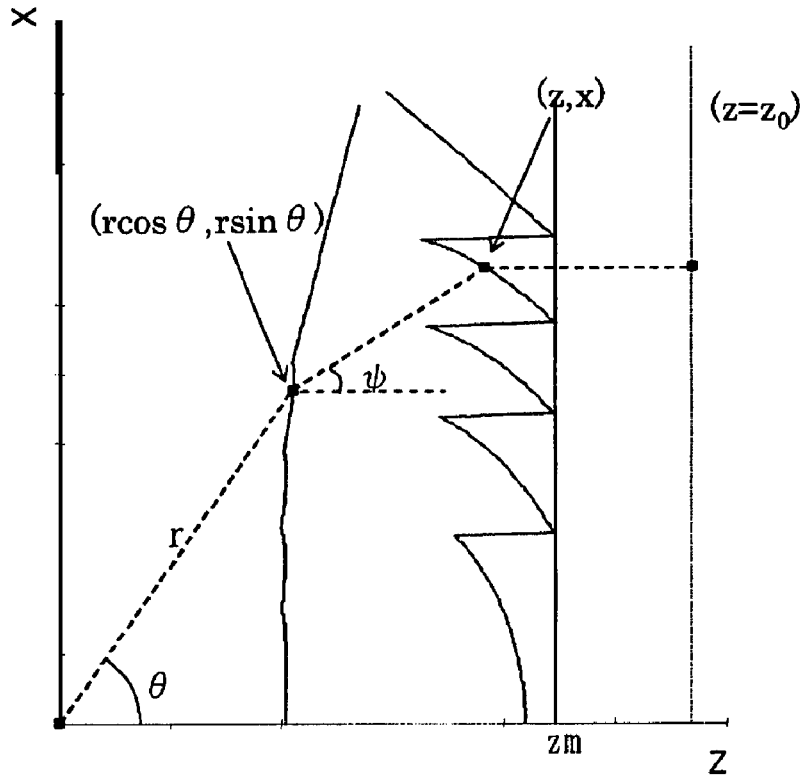
FIG. 6 is a diagram illustrating the coordinates system of the above dielectric lens.

FIG. 6 illustrates the coordinates system of the dielectric lens. The shape of this dielectric lens is computed using geometric optics approximation. First, assuming that the dielectric lens is rotationally symmetrical on the z axis, the coordinates system to be used for computation is taken as shown in the drawing, the lens surface coordinates are represented as (z, x) of a rectangular-coordinate system, the lens rear-face coordinates are represented as (r, θ) of a polar coordinate system, and also represented as (rcos θ, rsin θ) of a rectangular-coordinate system.

Further, the primary radiator is disposed at the origin 0, the directivity thereof is represented with Ep(θ), the phase properties thereof are represented with ϕ(θ), and also, the aperture distribution of a virtual aperture face in z=zo is represented with Ed(x). At this time, Snell's law holds regarding the surface and the rear face, respectively. The electric power conservation law must be held based on the conditions where the electric power emitted from the primary radiator is saved on an aperture face. Moreover, although a usual dielectric lens has the condition that the light path length to the virtual aperture face is constant, this is substituted with a new condition that "the light path length may be reduced in length by an integral multiple of the wavelength" in order to perform zoning.

Here, the front face can be mainly subjected to zoning and reduction in thickness by omitting Snell's law at the front face, and deriving a lens shape so as to satisfy Snell's law at the rear face, as well as the electric power conservation law and the light path length conditions. In addition, since the electric power conservation law is realized, the aperture distribution is equal to that before zoning even if zoning is performed. A specific example of the expression which should be solved can be expressed as follows.

Snell's Law at Rear face—Expression 1

$$\frac{dr}{d\theta} = r\frac{n\sin(\theta-\psi)}{n\cos(\theta-\psi)-1} \tag{1}$$

Electric Power Conservation Law—Expression 2

$$\frac{dx}{d\theta} = \frac{E_p^2(\theta)\sin\theta}{\int_0^{\theta_m} E_p^2(\theta)\sin\theta\, d\theta}\frac{\int_0^{R_m} E_d^2(x)x\,dx}{E_d^2(x)x} \tag{2}$$

Light Path Length Conditions—Expression 3

$$r + \frac{n(z-r\cos\theta)}{\cos\psi} + z_0 - z - \frac{\phi(\theta)}{k} = l_0 - m\lambda \tag{3}$$

In these expressions, m is an integer, λ is a wavelength within a medium (air), and lo is the light path length (constant) before zoning. θ is an angle formed by the primary ray and the optical axis when the primary ray of electromagnetic waves enters into the rear face of the dielectric lens from the origin 0, r is, as shown in FIG. 6, the distance from the origin (focal point) 0 to a predetermined point of the rear face of the dielectric lens, and ϕ is the angles of the primary ray of the electromagnetic waves which are refracted at the predetermined point of the rear face of the dielectric lens, and progress within the dielectric lens. n is the refractive index of the dielectric portion of the dielectric lens. θm is the maximum value of the angle θ when connecting the origin 0 to the circumferential edge of the lens with a straight line. Rm is the radius of the lens. Also, zo is the position on the z axis of the virtual aperture face, and k is a wave number.

The dashed line shown in FIG. 6 is the light path of the primary ray, r is obtained by determining θ, and the incidence position (rcosθ, rsinθ) of the primary ray on the rear face of the lens is obtained from θ and r. Further, ϕ is obtained by the incidence angle of the primary ray to the rear face of the dielectric lens, and the coordinates (z, x) on the surface of the lens are obtained.

The shape of the dielectric lens shown in FIG. 5A is obtained by converting the above expressions into simultaneous equations, and solving them.

Generally, the more uniform the aperture distribution is, the narrower the beam width is, but the side lobe level deteriorates. Conversely, the side lobe level is low in the event of an aperture distribution which rapidly falls off toward the end, but the beam width is great. A fundamental aspect of lens design is to optimize the aperture distribution under the given specifications. Naturally, this concept is also indispensable when subjecting the lens to zoning. However, design becomes very difficult in the event that aperture distribution may completely change before zoning and after zoning. If aperture distribution does not change before and after zoning, design is completed with the steps of (1) determining the specifications such as size and directivity, (2) determining aperture distribution which satisfies the specifications, and (3) designing a zoned lens, but on the other hand, if aperture distribution changes, the design process keeps looping, i.e., (1) determining the specifications, (2) determining a tentative suitable aperture distribution, (3) designing a zoned lens (with aperture distribution differing from (2)), (4) analyzing the aperture distribution using evaluation or simulation of the actual antenna properties, and (5) ending the processing if the aperture distribution satisfies the specifications. Otherwise, return to (2), and the aperture distribution is adjusted and redone.

Accordingly, it is very important in performing efficient design to perform zoning so that aperture distribution is not changed.

A point which should be noted here is that when zoning the front side and attempting to make the aperture distribution the same as before zoning, not only the front face but also the rear face will always change into a concentric circle shape.

With a lens whose the rear face is flat, such as a Fresnel lens or the lens shown in the Richard C. Johnson and Henry Jasik, "Antenna engineering handbook 2nd edition", McGraw-Hill (1984), it is impossible by zoning only the surface side thereof to make the opening side distribution the same as that before zoning.

According to the present invention, while the surface side is subjected to zoning greatly in a concentric circle shape, the rear face side is also deformed in a concentric circle shape, thereby maintaining desired aperture distribution even after zoning.

Figure 7:
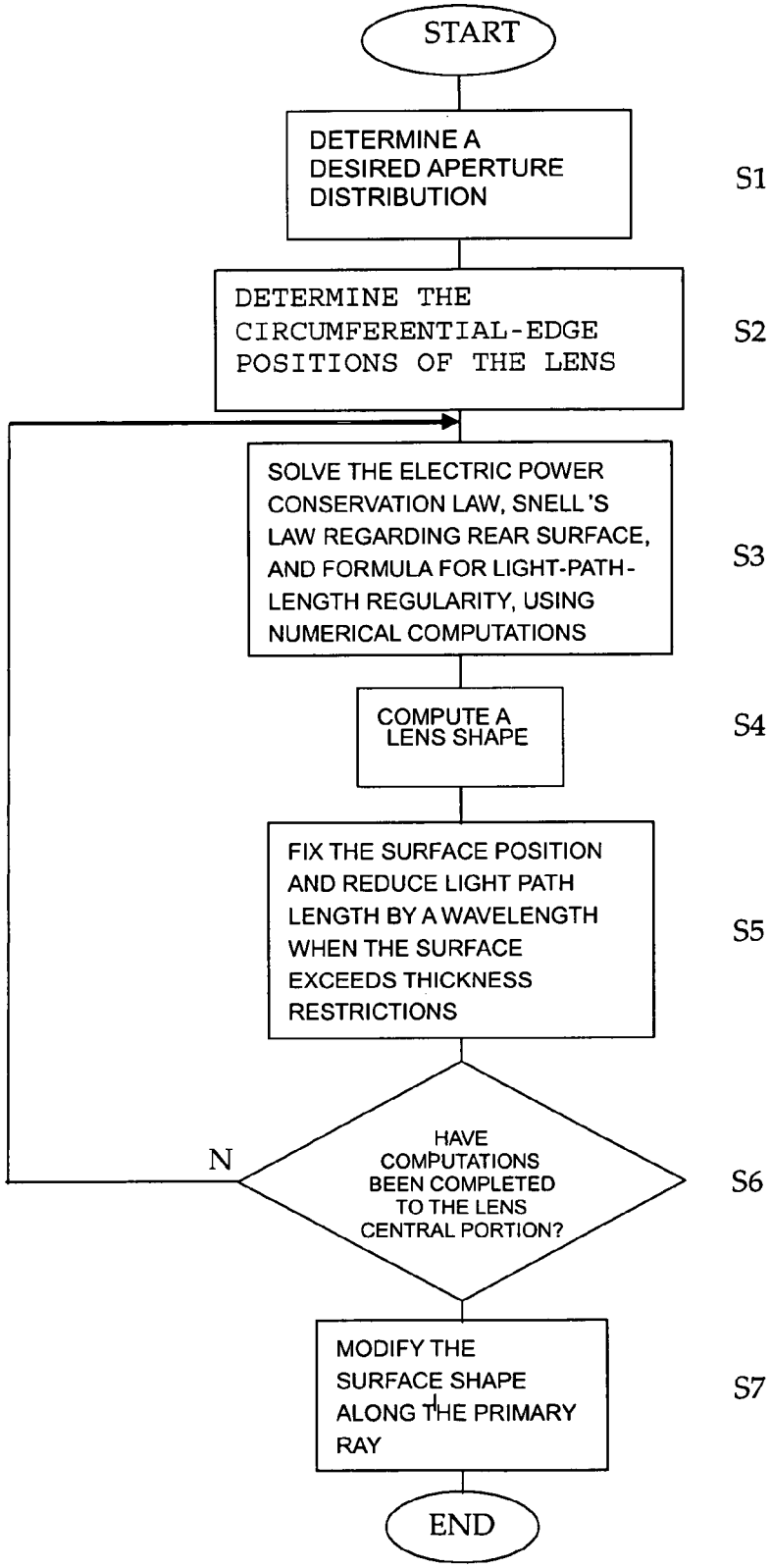
FIG. 7 is a flowchart illustrating the design procedures of the above dielectric lens.

FIG. 7 is a flowchart illustrating the procedures of the design method of the above dielectric lens. First, an aperture distribution is determined (S1). The following various distributions can be taken as this opening side distribution.

Parabolic Taper Distribution—Expression 4

$$E_d(r)=c+(1-c)(1-r^2)^n \tag{4}$$

c and n are parameters for determining the shape of this distribution.

Generalized Three Parameter Distribution—Expression 5

$$E_d(r) = c + (1-c)(1-r^2)^\alpha \frac{\Lambda_\alpha(j\beta\sqrt{1-r^2})}{\Lambda_\alpha(j\beta)} \tag{5}$$

Λα is a lambda function and is represented as follows using a gamma function (Γ) and the Bessel function (Jα).

Expression 6

$$\Lambda_\alpha(\xi) = 2^\alpha\Gamma(\alpha)\frac{J_\alpha(\xi)}{\xi^\alpha} \tag{6}$$

Here, c, α, and β are parameters for determining the shape of this distribution.

Gaussian Distribution—Expression 7

$$E_d(r)=\exp(-\alpha r^2) \tag{7}$$

Here, α is a parameter for determining the shape of this distribution.

Polynomial Distribution—Expression 8

$$E_d(r)=c+(1-c)(1+\alpha_1 r^2+\alpha_2 r^4+\alpha_3 r^6+\alpha_4 r^8+\alpha_5 r^{10}-(1+\alpha_1+\alpha_2+\alpha_3+\alpha_4+\alpha_5)r^{12}) \tag{8}$$

c and a1 through a5 are parameters for determining the shape of this distribution.

Taylor Distribution—Expression 9

$$E_d(r) = \frac{2}{\pi^2} + \sum_{m=1}^{n-1} g_m J_0(\lambda_m r) \tag{9}$$

J0 is a zero-order Bessel function, λm are zero points (J1(λm)=0) of a first-order Bessel function which are arrayed in ascending order, and gm is a constant which will be determined if order n and a side lobe level are given.

Modified Bessel Distribution—Expression 10

$$E_d(r)=\alpha+bJ_0(\lambda_1 r) \tag{10}$$

λ1 is equal to 3.8317, and b is equal to a−1. a is a parameter for determining the shape of this distribution.

Cosine Exponential Distribution—Expression 11

$$E_d(r) = c + (1-c)\cos^n\left(\frac{\pi r}{2}\right) \tag{11}$$

c and n are parameters for determining the shape of this distribution.

Holt Distribution—Expression 12

$$E_d(r) = 1 \quad (0 \le r \le r_1) \tag{12}$$

$$E_d(r) = 1 + \frac{1-b}{2}\left(\cos\frac{\pi(r-r_1)}{1-r_1} - 1\right) \quad (r_1 < r \le 1)$$

b and r1 are parameters for determining the shape of this distribution.

Uniform Distribution—Expression 13

$$E_d(r)-1 \tag{13}$$

Now, returning to FIG. 7, the circumferential edge position of the lens is determined next (S2).

For example, with the example shown in FIG. 5A, x=−45 [mm] or +45 [mm] is the circumferential edge position. Next, the electric power conservation law, Snell's law at the rear face, and the formula showing light-path-length constraint, are converted into simultaneous equations, and the solution of those equations is obtained using numerical computations (S3).

At this time, the expression showing the electric power conservation law is written by a differentiation system, and highly precise calculation is attained by calculating this by, for example, the Dormand & Prince method. Also, calculating the expression showing Snell's law using polar coordinates brings differentiation in the lens central portion to 0, thereby facilitating calculation. If this expression is expressed in writing using a rectangular-coordinates system, differentiation diverges at the lens central portion (inclination becomes infinite), and accordingly, the accuracy of the numerical computation result thereof drops markedly.

Subsequently, the coordinates (z, x) on the new surface of the lens, wherein the value of z is shorter by one wave length on the light with the value of x fixed, when z reaches the maximum defined beforehand by change of θ, are obtained (S4→S5).

The above processing is repeated until θ goes from θm to 0 (S4→S5→S6→S3→and so on). Thus, a thin dielectric lens of which the lens face does not exceed zm is designed.

Note that description will be made later regarding step S7 in FIG. 7.

Figure 8:
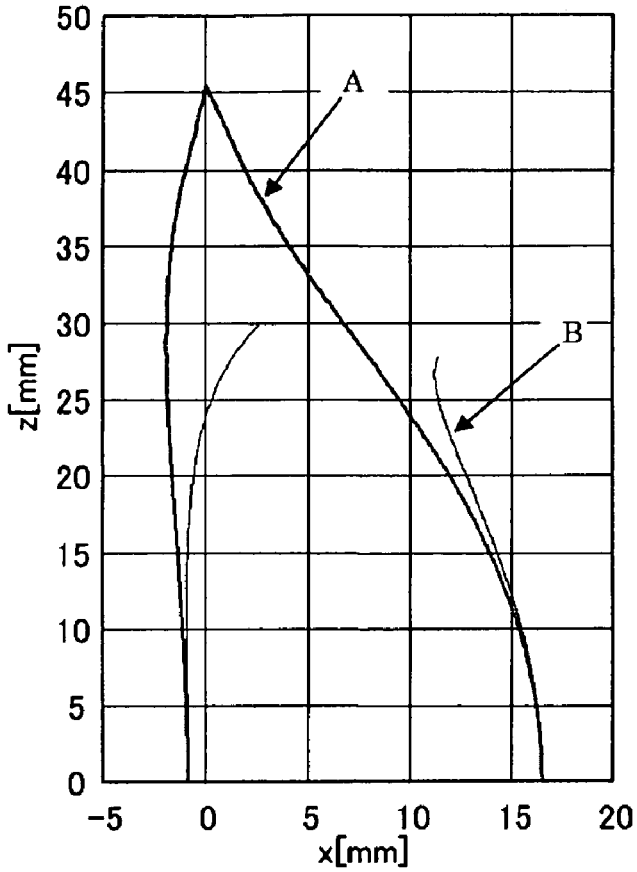
FIG. 8 is a diagram illustrating the difference in the calculation result by the difference in the calculation starting point of a dielectric lens.

FIG. 8 shows the result when changing the starting point of the calculations. Here line A is the result in the case of starting the calculations from the circumferential edge portion, and line B is the result in the case of starting the calculations from the central portion. However, zoning is not performed here in order to compare the shape near the circumferential edge of the lens. Thus, if the calculations are started from the circumferential edge portion, a dielectric lens of a desired size (radius 45 mm) can be designed correctly, but on the other hand, if the calculations are started from the central portion, the error becomes large near the circumferential edge of the dielectric lens, and a situation in which the lens surface side and the rear face side do not converge at a predetermined position also occurs.

Figure 9:
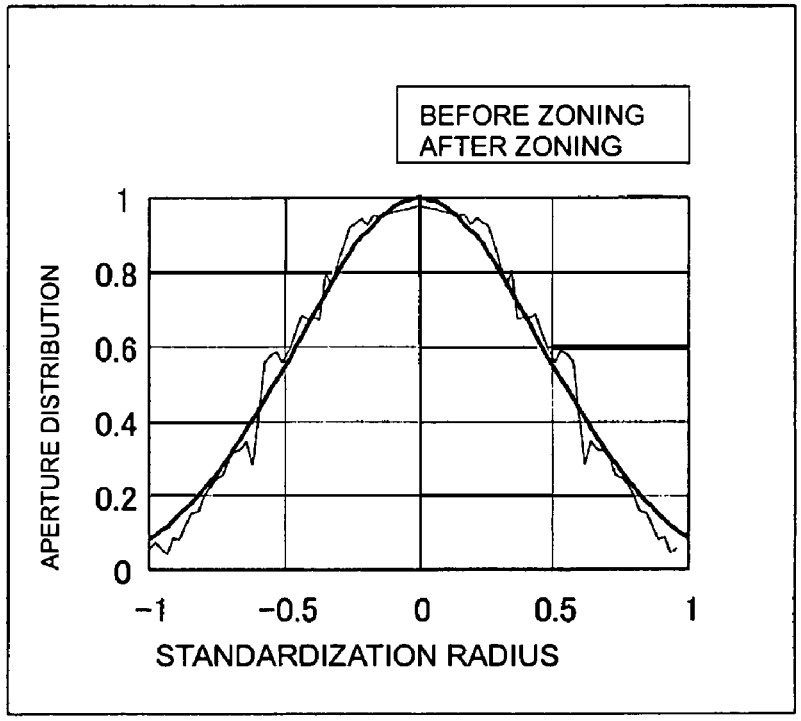
FIG. 9 is a diagram illustrating an example of change of aperture distribution before and after zoning.

FIG. 9 illustrates change in aperture distribution before and after zoning. Here, the thick line is the aperture distribution before zoning, and the thin line is the aperture distribution after zoning. The standardization radius of the horizontal axis is the value when setting the radius of the dielectric lens to 1. Also, the value of the aperture distribution is a value of which the maximum value is 1, and of which the minimum value is 0. Thus, although there is slight disturbance after zoning due to diffraction effects, generally the same aperture distribution as that before zoning is obtained. Thus, a thin and lightweight dielectric lens can be obtained mainly by subjecting the lens front side to zoning, while making the aperture distribution equal to that before zoning.

After designing the shape of the back-and-front surfaces of the dielectric lens shown in FIG. 5B in this way, an injection-molding mold formed of resin is designed and created so that a rotationally symmetrical object with the optical axis as the rotation center is obtained. The circumferential edge portion of the dielectric lens of a predetermined radius may be discarded, with the edge portion of the dielectric lens shorter than the above-mentioned design radius. Also, besides than a circular shape, an arrangement may be made wherein, when viewing the dielectric lens from the optical axis, a general square shape or a general rectangular shape obtained by cutting off the four sides following straight lines may be employed. Furthermore, in order to facilitate attachment of the dielectric lens to a chassis, a flange portion may be provided which has a bolt hole in the region through which electromagnetic waves do not pass.

As for the dielectric material making up the lens, resin, ceramics, a resin-ceramic composite material, an artificial dielectric material with metal cyclically arrayed therein, a photonic crystal, and other materials of which specific inductive capacity is other than 1 may be employed.

Also, the dielectric lens is manufactured by processing such dielectric materials by cutting, the injection-molding, compression molding, optical modeling, or the like.

Next, a description will be made regarding a dielectric lens according to a second embodiment and the design method thereof, with reference to FIG. 10A through FIG. 12C.

Figure 10A:
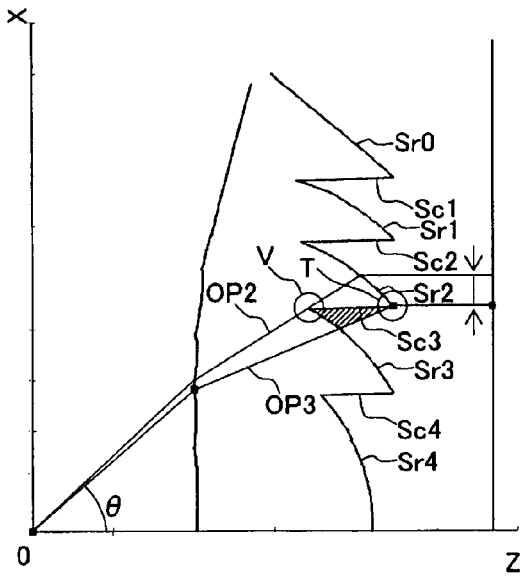
FIGS. 10A to 10C are diagrams illustrating a correction example of the stepped face caused by the zoning of the dielectric lens according to a second embodiment.

FIG. 10A is a cross-sectional view of the principal portions on the surface of the dielectric lens including the optical axis, designed by the processing from step S1 through step S6 in FIG. 7. With the above-mentioned processing alone, z is reduced while fixing x so that the light path length is shortened by one wave length when z of the coordinates (z, x) on the surface of the lens reaches the upper limit zm, so the stepped faces Sc (Sc1-Sc4) become faces parallel to the optical axis. With such a shape, sharply pointing portions (valley V and mountain T) are formed on the boundary of the refraction face and the stepped face. Accordingly, the inclination angles of the stepped faces Sc (Sc1-Sc4) are corrected as described next.

Figure 10B:
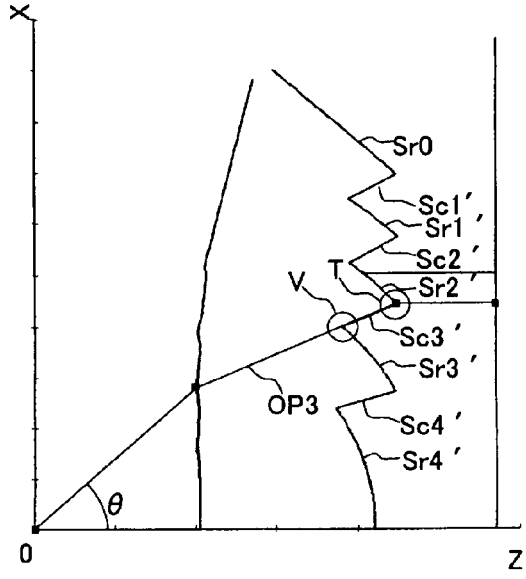
Figure 10C:
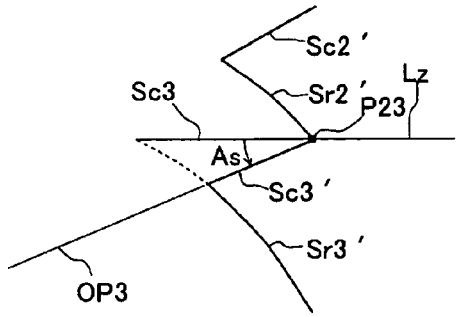

FIG. 10B is a cross-sectional view of the principal portions on the surface including the optical axis of the dielectric lens following the correction thereof, and FIG. 10C is a partially enlarged view thereof. Here, giving attention to the stepped face Sc3 between the front-side refraction faces Sr2 and Sr3, this stepped face Sc3 forms a cylindrical face centering on the z axis before correction of the inclination angles. On the z-x plane with an angle As formed by this stepped face Sc3 and a line Lz in parallel with the z axis as the inclination angle of the stepped face Sc3, the above inclination angle As is determined such that the stepped face Sc3 inclines toward the focal point (origin 0) direction rather than the thickness direction (z-axis direction) of the dielectric lens from a boundary P23 of stepped face Sc3' and the front-side refraction face Sr2'. Thus, the stepped face Sc3 constitutes a part of the side surface of the cone containing the straight line of the primary ray OP3.

The stepped faces Sc1', Sc2', Sc3', and Sc4' in FIG. 10B represent the stepped faces thus corrected respectively. The ranges of the front-side refraction faces Sr1', Sr2', Sr3', and Sr4' also change with this correction of the stepped faces.

In step S7 in FIG. 7, the correction processing of the inclination angles of the above stepped faces is performed.

Figure 11:
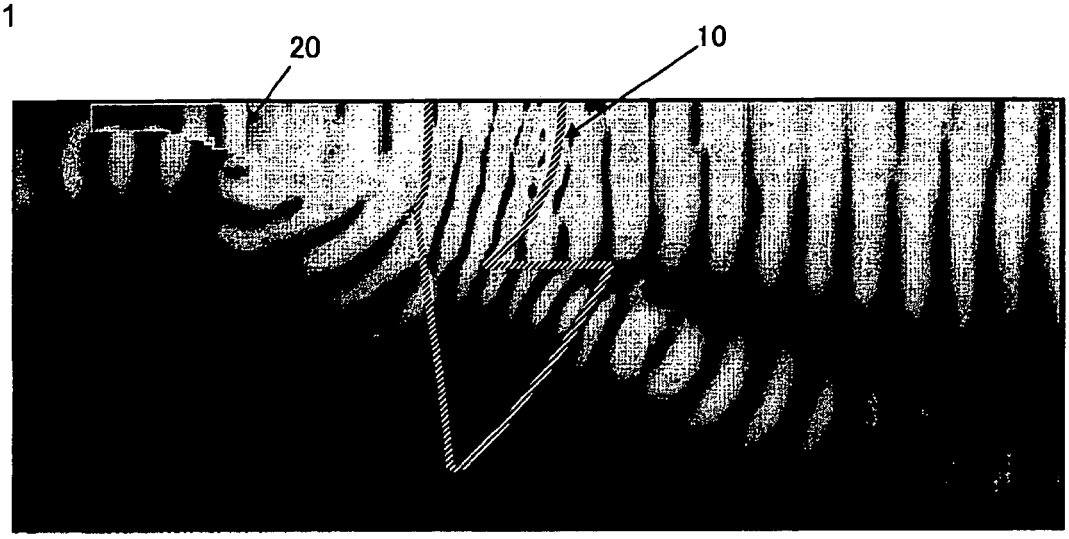
FIG. 11 is a diagram illustrating simulation results of a refraction phenomenon by zoning.

Correction of the inclination angles of the above-mentioned stepped faces is effective in that the diffraction phenomena due to disorder of the magnetic field distribution can be suppressed. FIG. 11 illustrates the result of a simulation which simulates the magnetic field distribution regarding a one-step zoned lens in which stepping occurs in one place. Here, 10 is a dielectric lens, and 20 is a primary radiator. Thus, the presence of an inwards-facing acute valley portion and an outwards-facing acute mountain portion, occurring on the boundary portion of the stepped face and the front-side refraction face adjacent thereto, disturbs the magnetic field distribution, and a side lobe occurs towards the lower right direction in the drawing due to diffraction phenomena. As shown in FIG. 10B, making the angles of the valley V and the mountain T which occur between the stepped face and the front-side refraction face adjacent thereto to be less steep prevents the magnetic field distribution from disturbance, whereby diffraction phenomena can be suppressed.

Figure 12A:
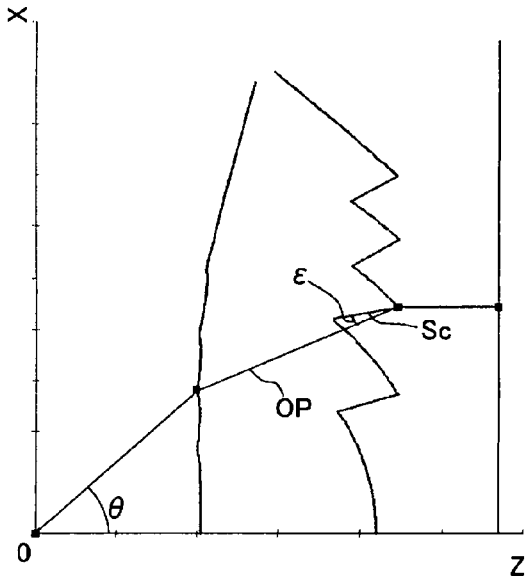
FIGS. 12A to 12C are diagrams illustrating the relation between change of the inclination angle of a stepped face and the amount of gain change thereby.
Figure 12B:
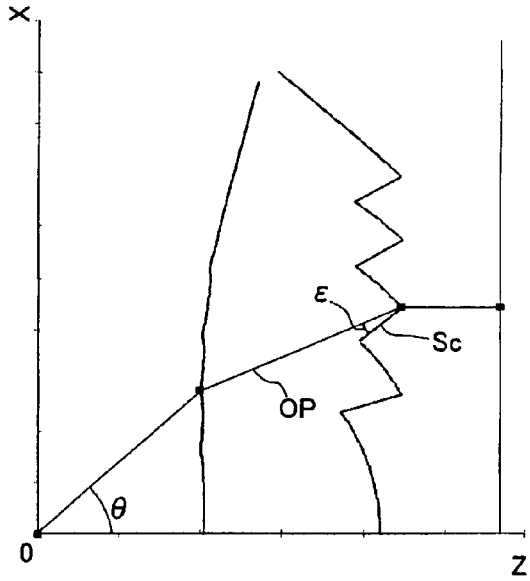
Figure 12C:
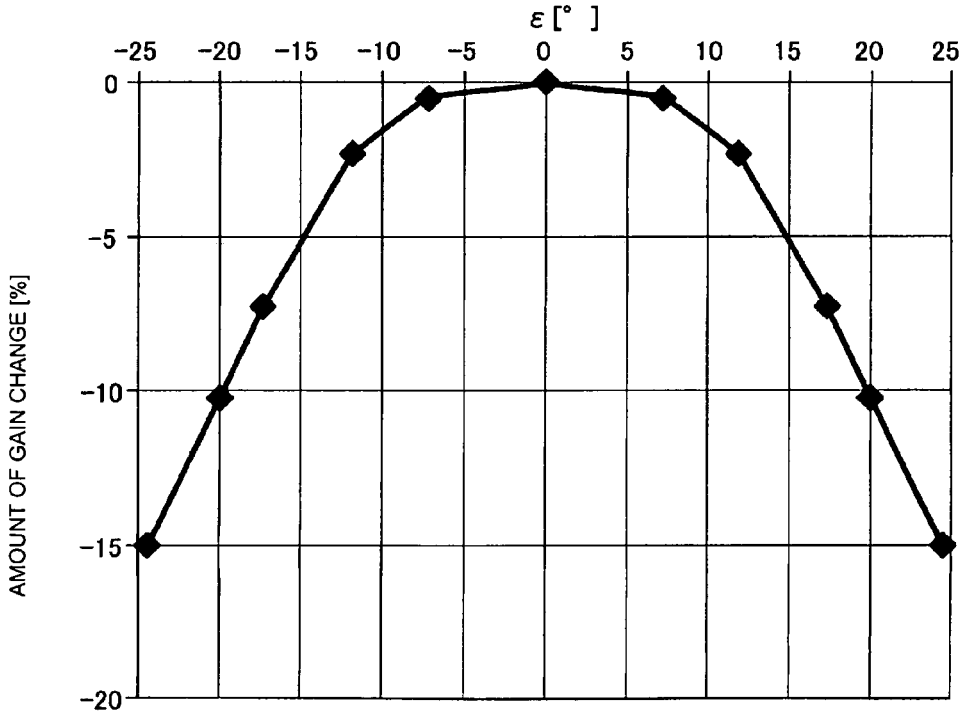

With the example shown in FIGS. 10A to 10C, the inclination angle of the stepped face has been determined such that the stepped face contains the primary ray of the electromagnetic waves which enter into an arbitrary position of the rear face of the dielectric lens from the origin (focal point) 0, are refracted, and progress through the dielectric lens, but the inclination angle of the stepped face has a certain amount of allowance for improving the gain, and suppressing the above diffraction. FIG. 12 illustrate the gain change due to change of the inclination angle. As shown in FIG. 12A, an angle $\epsilon$ formed by the optical path OP of the primary ray and the stepped face Sc is represented by + in a state in which correction of the inclination angle of the stepped face is insufficient, and is represented with − in a state in which the inclination angle is excessively inclined, and the amount of gain change when changing this angle $\epsilon$ is shown in FIG. 12C. The amount of gain change at the time of $\epsilon=0$ is set to 0 here. As can be clearly understood from this result, the acceptable value of gain change of a dielectric lens is generally about 10%, so within the range of inclination angle $\epsilon=\pm 20$ of the stepped face Sc enables good gain properties to be acquired.

Next, description will be made regarding a dielectric lens according to a third embodiment and the design method thereof with reference to FIG. 13A through FIG. 15B.

Figure 13A:
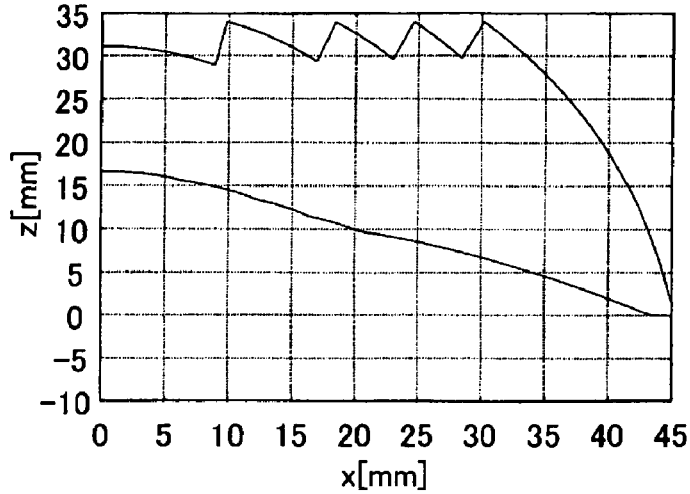
FIGS. 13A to 13C are diagrams illustrating an example of the shape change by the difference between aperture distributions to be provided regarding a dielectric lens according to a third embodiment.
Figure 13B:
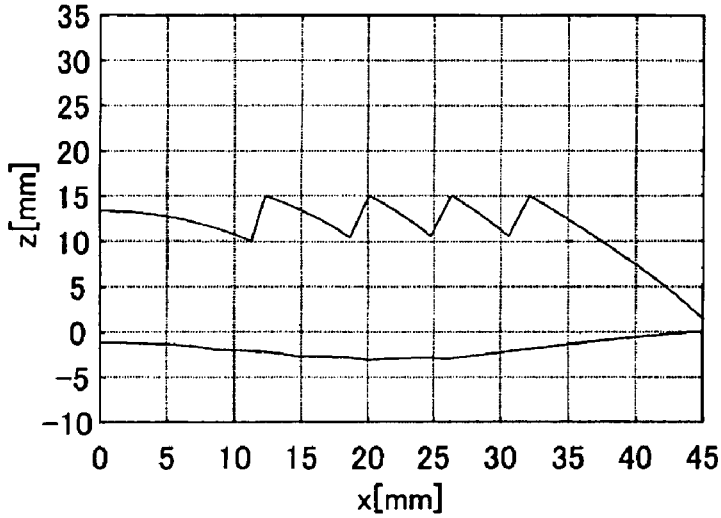
Figure 13C:
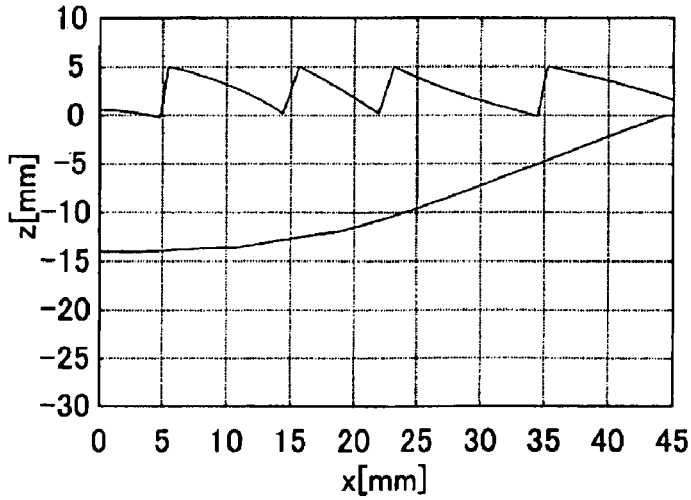
Figure 14:
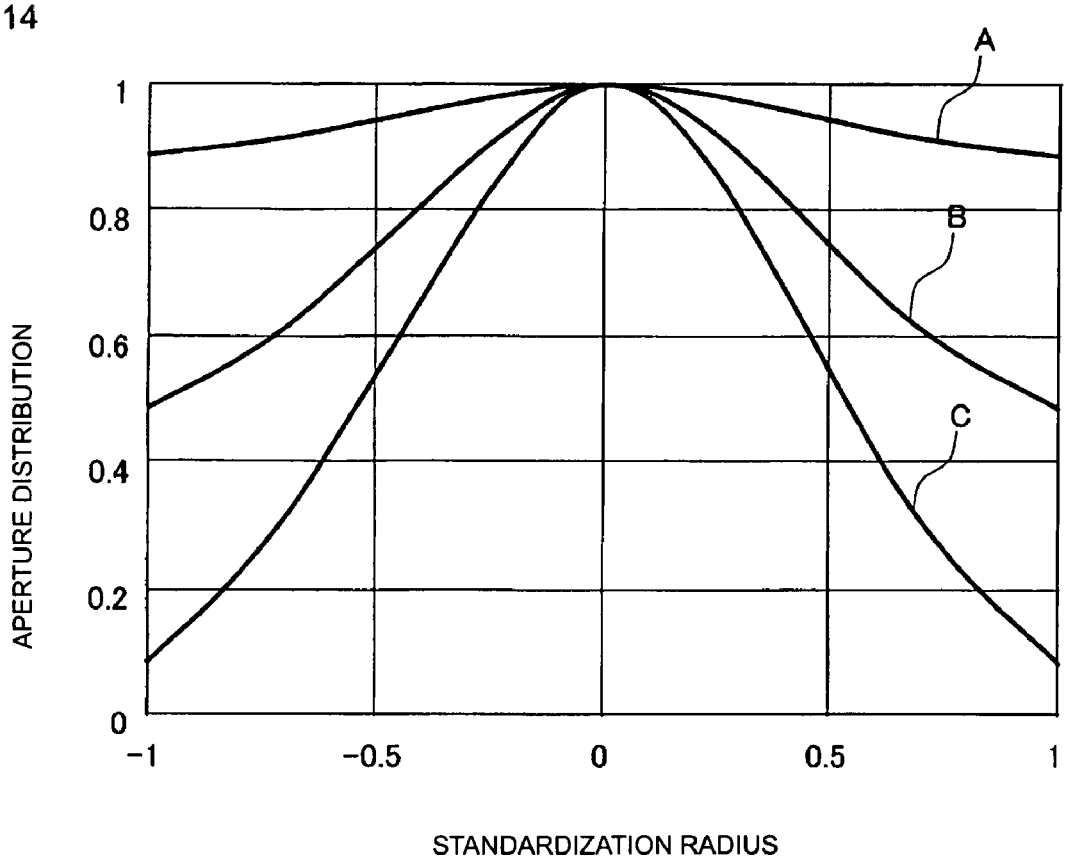
FIG. 14 is a diagram illustrating some examples of aperture distribution.
Figure 15A:
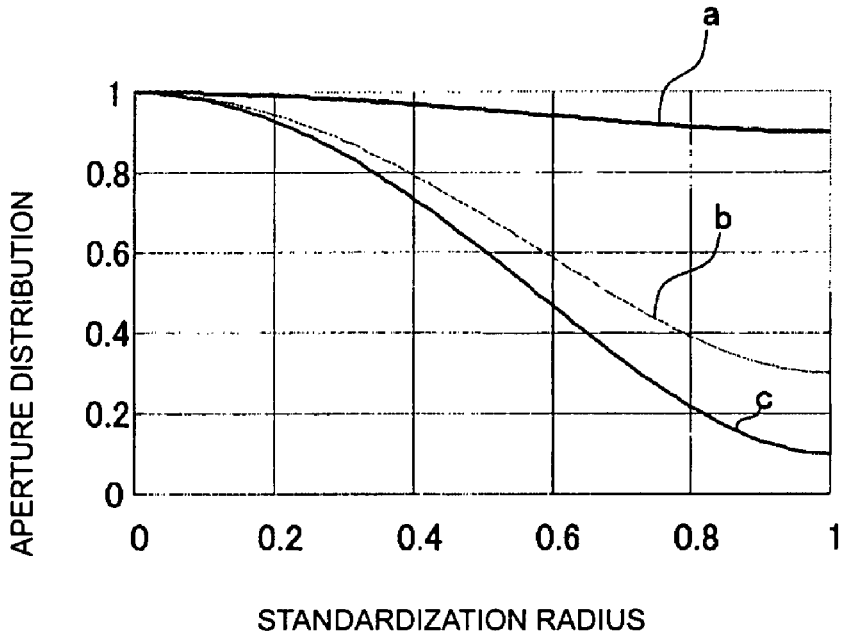
FIGS. 15A and 15B are diagrams illustrating the relation between aperture distribution and antenna directivity.
Figure 15B:
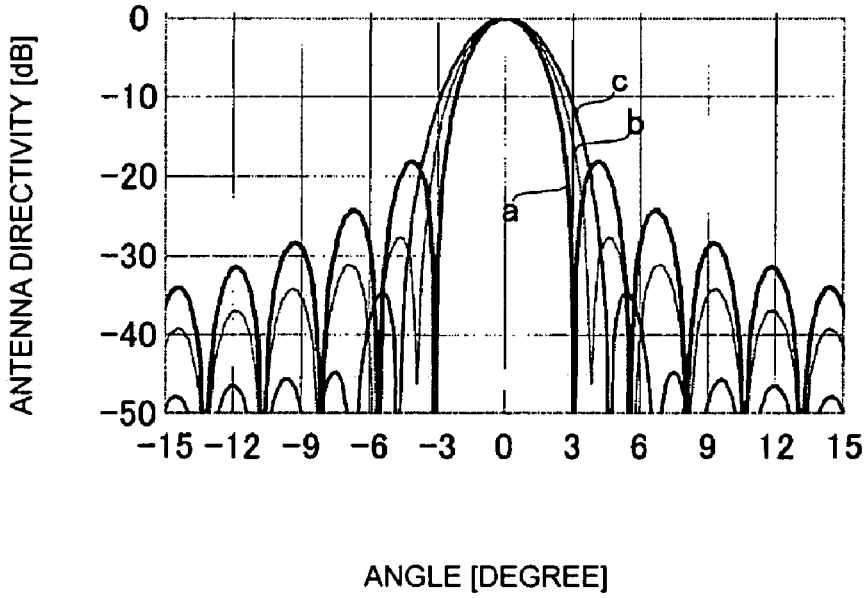

This third embodiment shows an example of change of the shape of the dielectric lens when changing aperture distribution. FIG. 14 illustrates an example of three types of aperture distribution. FIGS. 12A, 12B and 12C illustrate the shape of the dielectric lens where three aperture distributions in FIG. 14 were given and designed. FIGS. 15A, 15B and 15C correspond to FIGS. 14A, 14B and 14C respectively. The aperture distributions of FIG. 14 are all the parabolic taper distributions shown in Expression (4), with parameters c and n changing. Each example shown in FIG. 13 is an example of the four-step zoning in which steps occur in four places, wherein the closer to a convex shape the surface side of the dielectric lens is, the closer to uniformity the aperture distribution is, but conversely, the closer to a convex shape the rear face side of the dielectric lens is, the aperture distribution becomes a shape which falls off rapidly toward the circumferential edge portion from the central portion.

FIGS. 15A and 15B illustrate an example of a directive change of the antenna according to change of aperture distribution. Thus, in the event that aperture distribution is close to a uniform distribution as with a, the main lobe width is narrow, but a side lobe appears greatly overall. In the event that aperture distribution is a shape which attenuates rapidly from the central portion to the circumferential edge portion as with c, the width of the main lobe is large, but the side lobe is suppressed. Also, in the event that aperture distribution exhibits intermediate properties between a and c, as with b, the manifestation of the main lobe and the side lobe appear exhibits intermediate properties between a and c. The pattern of aperture distribution is determined so as to obtain such desired antenna directivity.

Figure 16A:
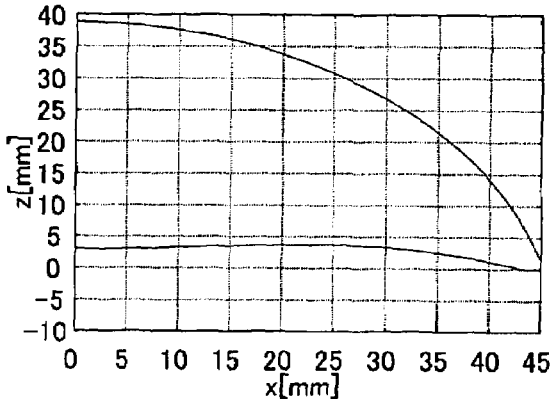
FIGS. 16A to 16F are diagrams illustrating the relation between the number of steps of zoning and the change in shape of a dielectric lens according to a fourth embodiment.
Figure 16B:
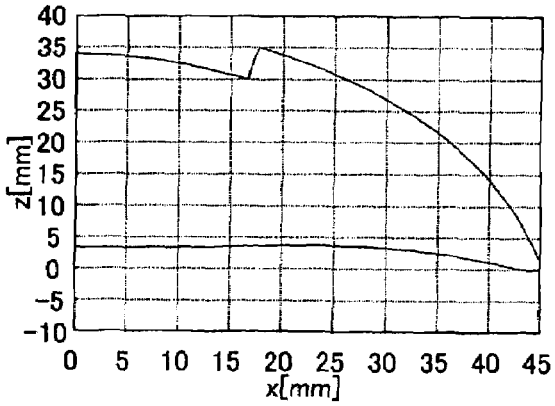
Figure 16C:
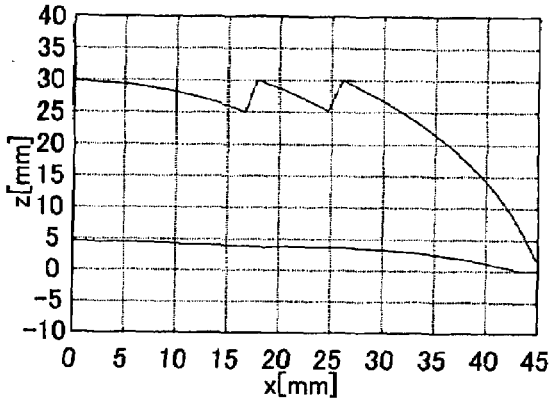
Figure 16D:
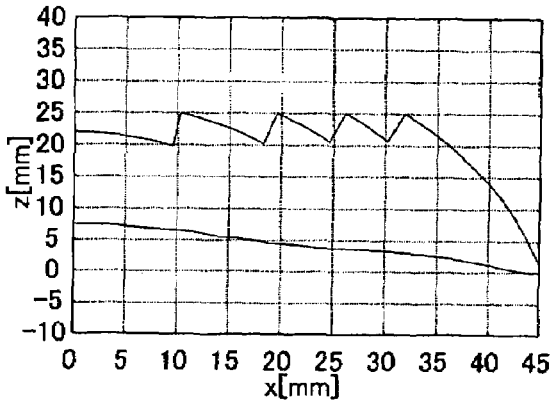
Figure 16E:
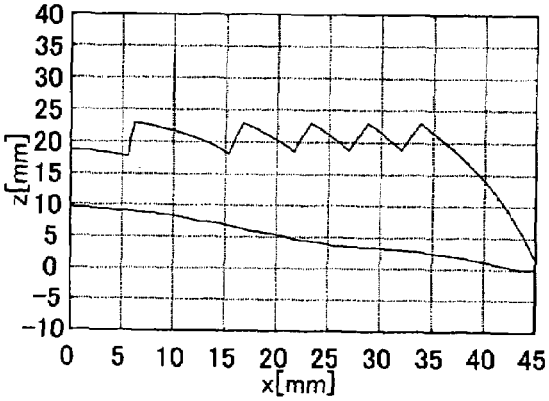
Figure 16F:
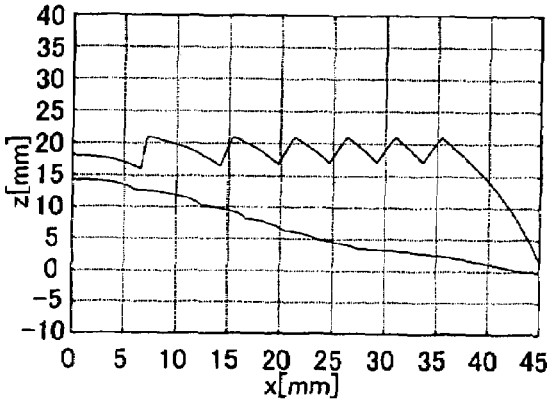

FIGS. 16A to 16F illustrate the shape and the design method of a dielectric lens according to a fourth embodiment. They illustrate the results when changing the restriction thickness position on the front side of the dielectric lens (zm shown in FIG. 6). FIG. 16A is the result when determining zm=40 [mm], FIG. 16B is when zm=35 [mm], FIG. 16C is when zm=30 [mm], FIG. 16D is when zm=25, FIG. 16E is when zm=23, and FIG. 16F is when zm=21, respectively. Zoning is not performed in FIG. 16A. One-step zoning is performed in FIG. 16B, two-step zoning in FIG. 16C, four-step zoning in FIG. 16D, five-step zoning in FIG. 16E, and six-step zoning in FIG. 16F. Thus, the more the number of steps of zoning increases, the thinner the dielectric lens can be made.

Also, the position of each point on the rear face side of the dielectric lens moves in the positive direction of the z axis (the surface direction of the dielectric lens) as the number of steps of zoning increases, whereby the volume of the dielectric lens can be reduced, and reduction in weight can be realized by that much.

Figure 17A:
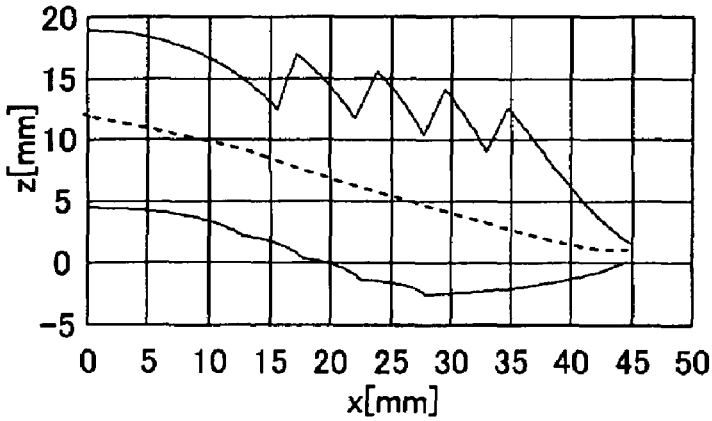
FIGS. 17A to 17C are diagrams illustrating an example of the thickness restriction curve of a dielectric lens, and an example of division molding of a dielectric lens.
Figure 17B:
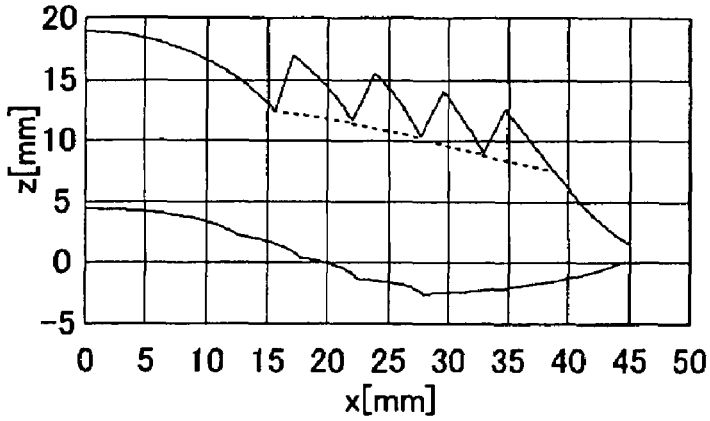
Figure 17C:
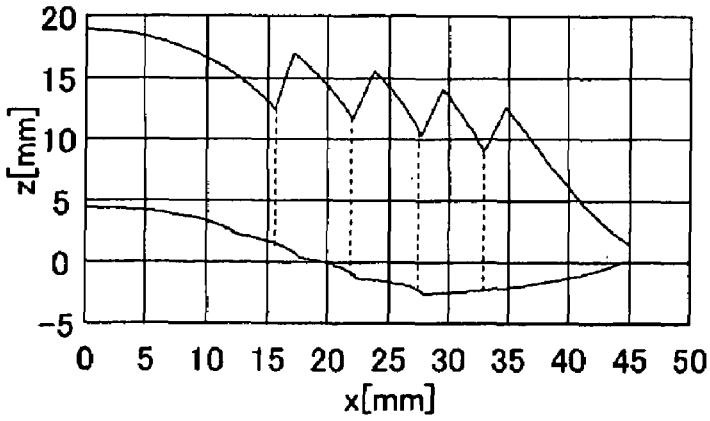

FIG. 17 illustrate the design method and manufacturing method of a dielectric lens according to a fifth embodiment. When the dielectric lens shown in each above-mentioned embodiment is manufactured by molding, it is not necessarily crucial to carry out integral molding, but the respective portions may be molded individually and then bonded. In FIG. 17, the dashed line shows the division face. For example, as shown in FIG. 17A, a dielectric lens may be divided into the rear face side and the front side. Also, as shown in FIG. 17B, the protruding portion on the front side of a dielectric lens caused by zoning may be molded separately from the remaining main body portion. Further, as shown in FIG. 17C, an arrangement may be made wherein division molding is carried out at the valley portions formed between the front-side refraction faces and stepped faces of the dielectric lens produced by zoning, and then combined.

Figure 18A:
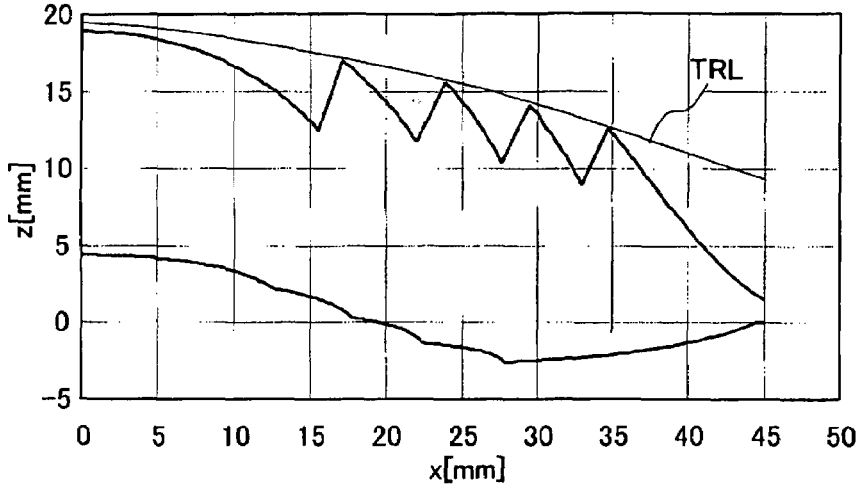
FIGS. 18A and 18B are diagrams illustrating the shape of a dielectric lens and the properties of antenna directivity according to a sixth embodiment.
Figure 18B:
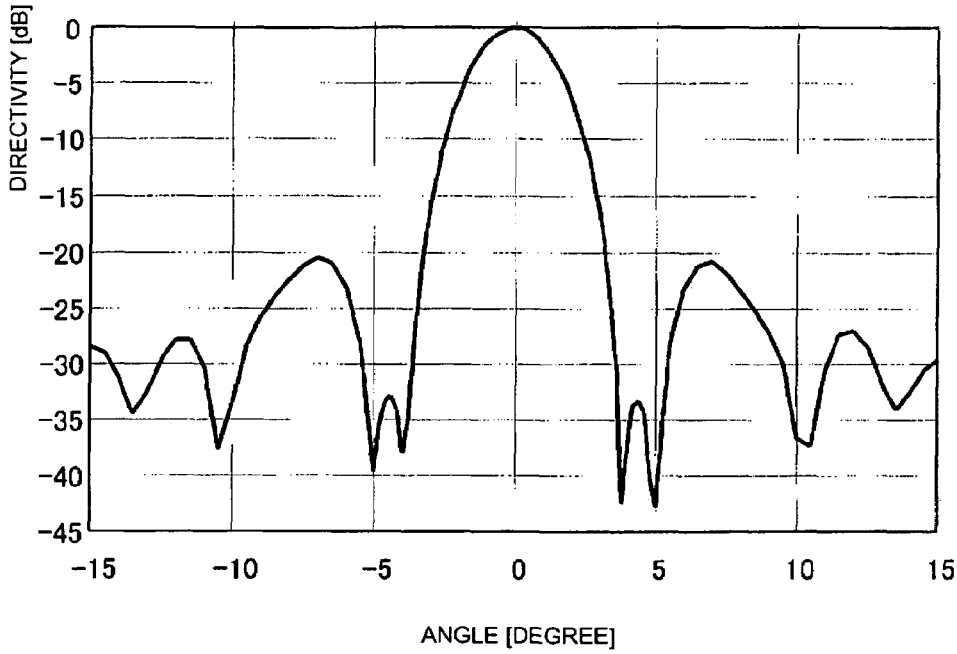

FIGS. 18A and 18B illustrate an example of the shape, design method, and directivity of a dielectric lens according to a sixth embodiment. FIG. 18A is a cross-sectional view at a flat face including the optical axis of the dielectric lens. With each embodiment shown above, determination has been made regarding whether or not the coordinates on the surface of the dielectric lens reach a predetermined restriction thickness position by the position thereof being stipulated by the straight line z=zm, but this can be determined with an arbitrary curve. The example shown in FIG. 18 are the result of an arrangement wherein a thickness restriction curve TRL which forms a curve on the x-z flat face is determined, and the light path length in the formula for light-path-length constraint is reduced by one wave length of the wavelength within the dielectric lens at the point of the coordinates on the surface of the dielectric lens reaching this thickness restriction curve. Thus, by determining the thickness restriction curve TRL, the outline shape of the surface of the dielectric lens can be united with the surface of revolution of the thickness restriction curve TRL. By determining the thickness restriction curve TRL such that z is generally large in the lens central portion, and is smaller toward the circumferential edge, the change in thickness from the central portion to the circumferential edge portion of the dielectric lens by zoning is reduced, and mechanical strength improves. Moreover, fabrication with molds is facilitated. Moreover, coma aberration can be reduced by the rear face of the dielectric lens approaching an arc shape, by determining TRL well.

In this example, the coordinates (x, z) of the circumferential edge position on the rear face side of the dielectric lens (calculation starting position) are set to (45, 0), and the coordinates (x, z) of the circumferential edge position on the surface side (calculation starting position) are set to (45, 2).

FIG. 18B illustrates the directivity in the direction of an azimuthal angle which sets the direction of the optical axis of a dielectric lens to 0. Here, the primary radiator has a radiation pattern expressed with the shape of $\cos^{3.2}\theta$. Thus, dielectric lens antenna properties having sharp directivity wherein the level difference between the main lobe and the greatest side lobe is 20 dB or more, and also the beam width which attenuates −3 dB is 2.8°, is obtained.

Figure 19A:
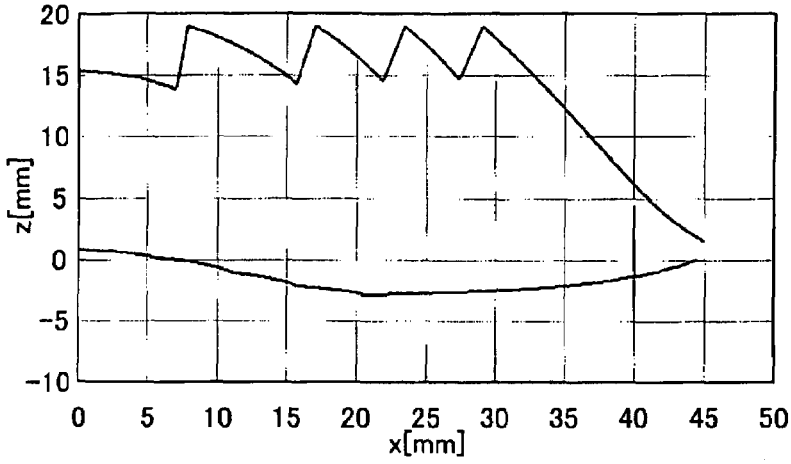
FIGS. 19A to 19C are diagrams illustrating an example of shape change by subjecting a dielectric lens according to a seventh embodiment to equal zoning and unequal zoning.
Figure 19B:
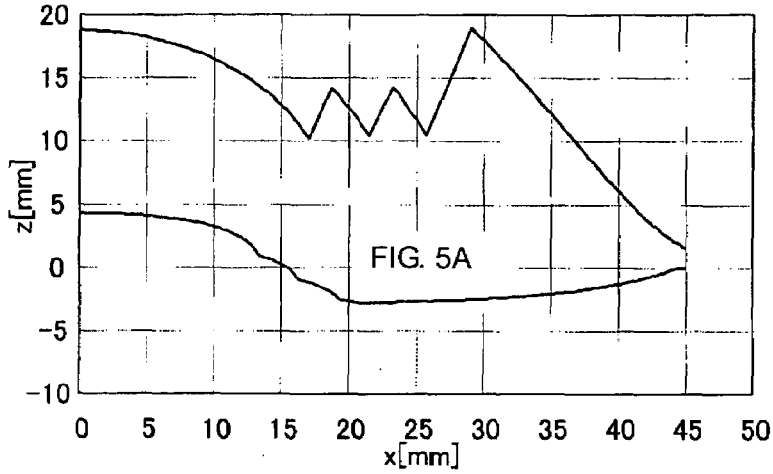

FIG. 19 illustrate a dielectric lens and the design method thereof according to a seventh embodiment. With each embodiment shown until now, the light path length in the formula showing light-path-length constraint has been reduced by one wavelength of the wavelength within the dielectric lens when the coordinates on the surface of the dielectric lens reached a predetermined restriction thickness position, but the light path length may be reduced by integral multiples, such as two wavelengths or three wavelengths. The example shown in FIG. 19A is the result of having been designed so as to reduce the light path lengths of all regions by one wavelength each, with the restriction thickness position of zm=19. FIG. 19B is the result of having reduced the light path length by two wavelengths each for the circumference portion of x=45 through 25 and the central portion of x=0 through 15 (mm), and by one wavelength for the other range of x=15 through 25.

Generally, the portions contributing most to antenna properties are the central portion and circumferential portion of aperture distribution. Uneven zoning as shown in FIG. 19B enables the diffraction phenomena to be suppressed since the number of steps becomes fewer at the central portion and the circumference portion of the dielectric lens, thereby enabling desired antenna properties to be acquired easily.

Figure 19C:
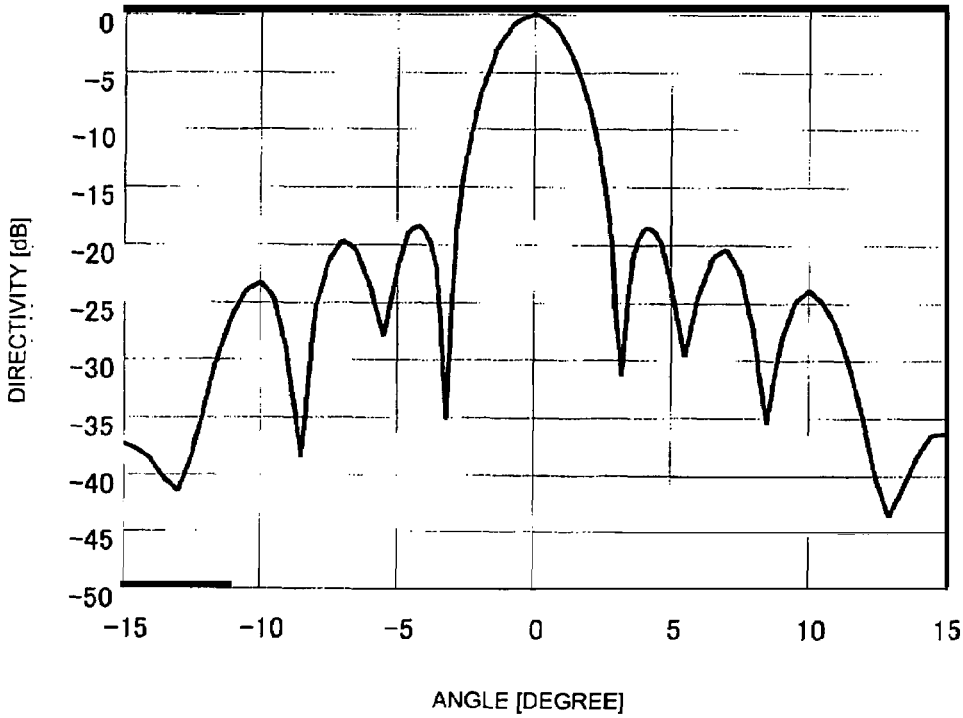

FIG. 19C shows the directivity of the antenna using the dielectric lens of the shape shown in FIG. 19B. As can be understood by comparing with FIG. 18B, the beam width narrowed down to 2.6 degrees, and as for directivity, in FIG. 18B, a second side lobe (side lobe adjacent to the outside of a first side lobe) is larger than the first side lobe (side lobe nearest the main lobe) due to the diffraction phenomena, and directivity is disturbed somewhat, but with the example in FIG. 19C, it can be seen that diffraction has been suppressed, and the first, second, and third side lobes appear clearly, signifying suppression of the diffraction phenomena.

In addition, all of the dielectric lenses shown in FIGS. 18 and 19, which use a resin material having a specific inductive capacity of 3 as the dielectric material thereof, have a diameter of 90 (mm) and focal distance of 27 (mm), with a parabolic taper distribution for the aperture distribution, and correspond to the 76 through 77 GHz band.

Next, description will be made regarding the configuration of a dielectric lens antenna according to an eighth embodiment with reference to FIG. 20 and FIG. 21.

Figure 20A:
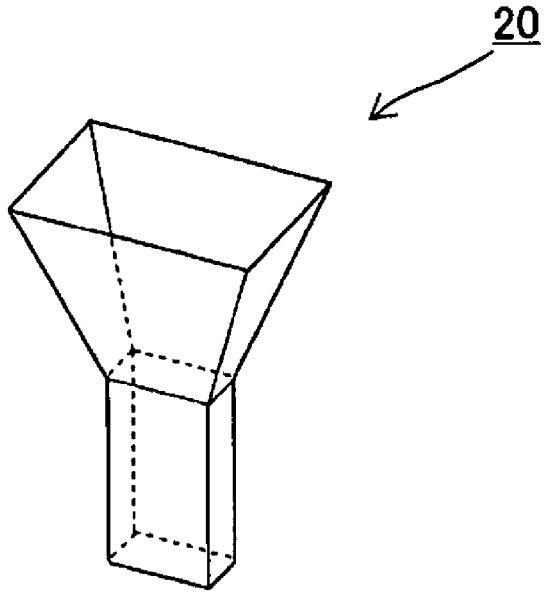
FIG. 20A is perspective view of the primary radiator used for dielectric lens antenna.
Figure 20B:
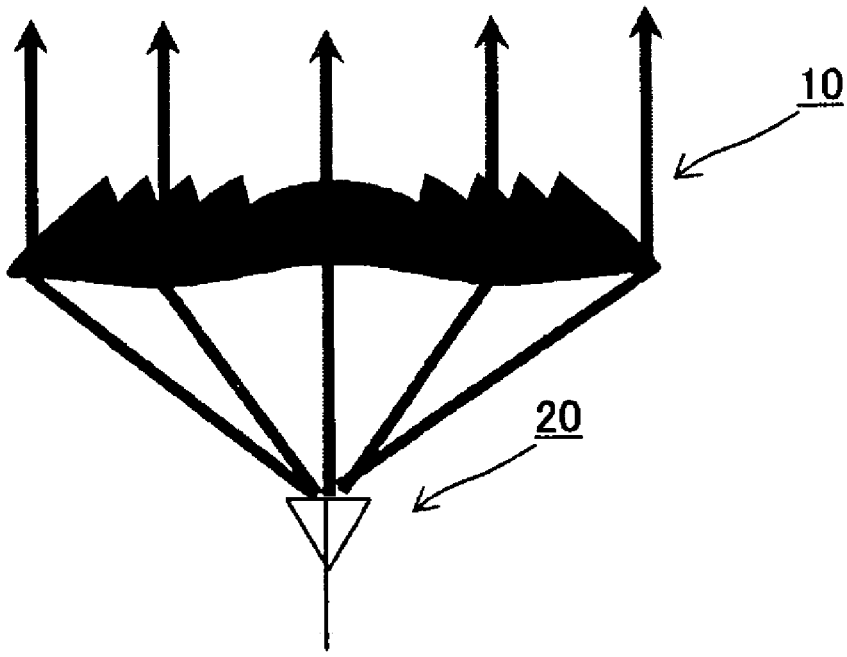
FIG. 20B is a planar cross sectional-view containing the optical axis of a dielectric lens antenna.
Figure 21A:
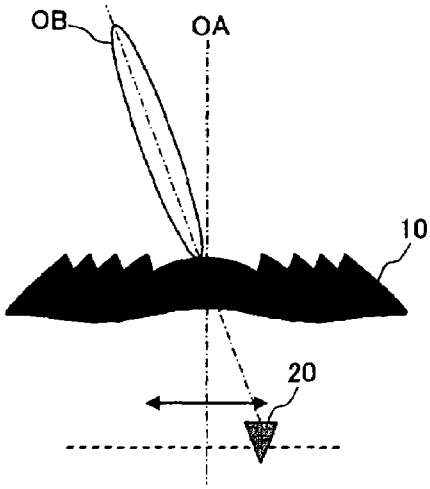
FIGS. 21A to 21D are diagrams illustrating the configuration of a dielectric lens antenna capable of scanning.
Figure 21C:
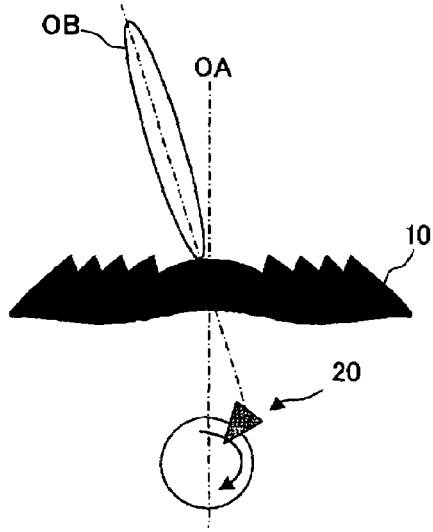
Figure 21B:
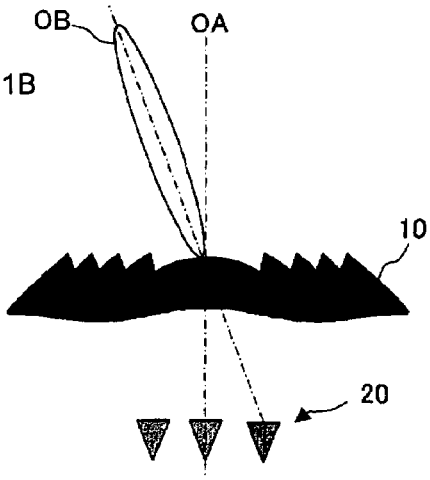
Figure 21D:
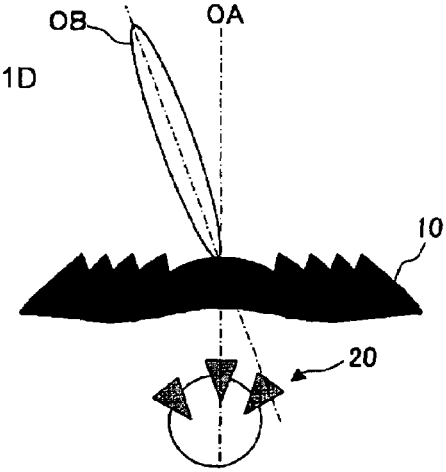

FIG. 20B is a planar cross-sectional view containing the optical axis of a dielectric lens antenna, and FIG. 20A is a perspective view of the primary radiator used for the dielectric lens antenna thereof. Here, a rectangle horn antenna is used as a primary radiator, and the sharpest directivity can be obtained in the direction of the optical axis by disposing the primary radiator 20 generally in the focal position of the dielectric lens antenna 10.

In addition, a circular horn, a dielectric rod, a patch antenna, a slot antenna, or the like can be employed as the above-mentioned primary radiator.

FIG. 21 shows the configurations of the dielectric lens antennas devised so that a transceiver beam can be scanned. Each of FIGS. 21A through 21D deflect the direction of transmission-and-reception wave beam OB which is determined according to the spatial relationships of this primary radiator 20 and dielectric lens 10 by moving the primary radiator 20 relatively to the dielectric lens. The example of FIG. 21A scans the transmission-and-reception wave beam OB by moving the primary radiator 20 relatively to the dielectric lens over a face which is perpendicular to the optic-axis OA and passes near the focal position. The example of FIG. 21B disposes multiple primary radiators 20 within the face which is perpendicular to the optic-axis OA and passes near the focal position, to scan the transmission-and-reception wave beam OB by switching these using an electronic switch. The example of FIG. 21C scans the transmission-and-reception wave beam OB by making the primary radiator 20 rotate mechanically near the focal position of the dielectric lens 10. The example of FIG. 21D disposes multiple primary radiators 20 on the predetermined curved face or the curve near the focal position of the dielectric lens 10, and scans the transmission-and-reception wave beam OB by changing with an electronic switch.

With each dielectric lens as mentioned above, a recessed portion like an acute valley is created between the stepped face and the refraction face, and dust, rain, and snow can readily stick to or collect in this recessed portion. With the following ninth through eleventh embodiments, description will be made regarding a dielectric lens device having this configuration which prevents dust, rain, and snow from sticking.

Figure 22A:
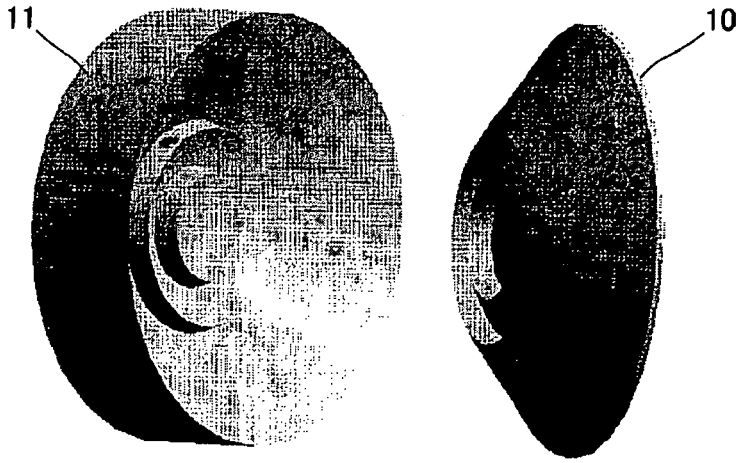
FIGS. 22A to 22C are diagrams illustrating the configuration of a dielectric lens device according to a ninth embodiment.
Figure 22B:
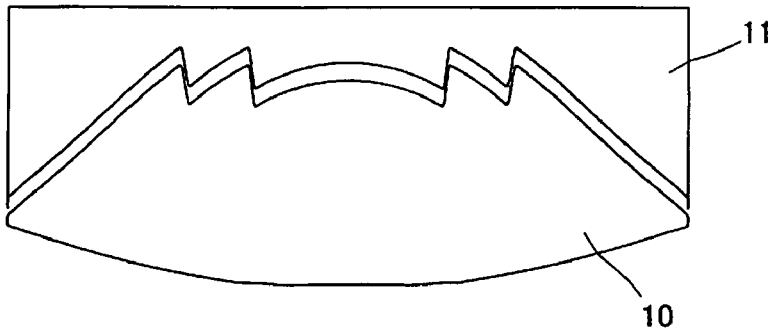
Figure 22C:
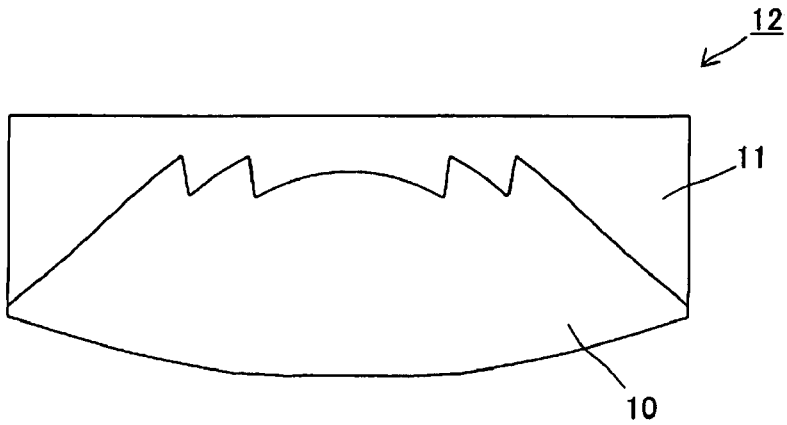
Figure 23A:
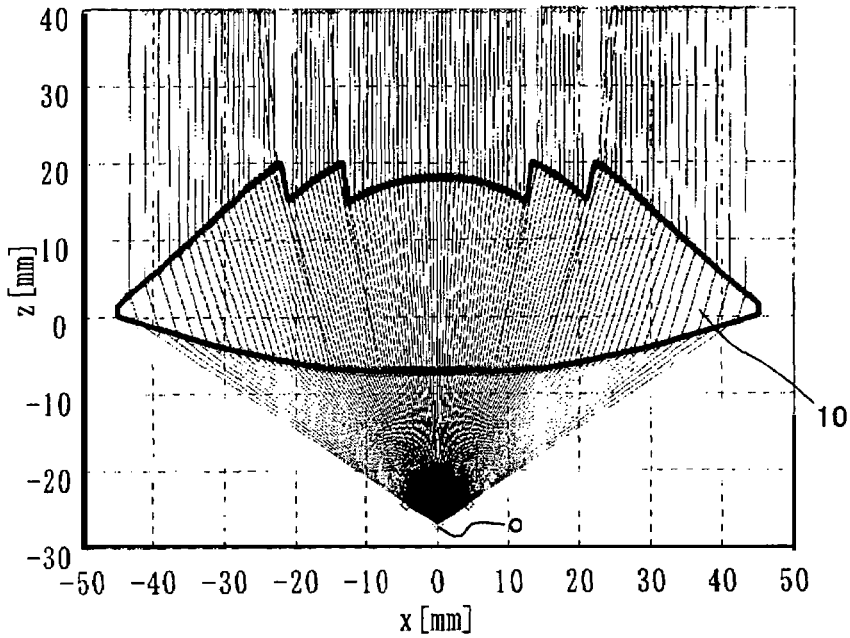
FIGS. 23A and 23B are diagrams illustrating the rate trace result of the above dielectric lens device.

FIG. 22 and FIG. 23 are diagrams illustrating the configuration of a dielectric lens device according to a ninth embodiment. FIG. 22A is an external view of a state in which a dielectric lens 10 is separated from a radome 11 which is provided on the surface side thereof. Also, FIG. 22B is a cross-sectional view immediately before combining a dielectric lens and a radome, and FIG. 22C is a cross-sectional view of a dielectric lens device 12 wherein the two are assembled.

The dielectric lens 10 is any one of the zoned lenses shown in the first through eighth embodiments, and can be employed as an antenna for in-vehicle 76-GHz-band radars. Specifically, this lens is 90 mm in diameter, and 27 mm in focal distance, and is molded with a resin material of specific inductive capacity 3.1.

As shown in FIGS. 22, the radome 11 has a shape which fills a recessed portion so as to eliminate the unevenness of the front side of the dielectric lens 10, and also makes the front side of the dielectric lens a plane.

This radome 11 consists of foaming material (resin foam) of specific inductive capacity of 1.1. That is to say, this radome 11 is prepared by providing a model for casting the above-mentioned foaming material in the surface side of the dielectric lens 10, and injecting the foaming material into that model.

Note that the radome 11 may be molded independently of the dielectric lens 10. In this case, adhering the dielectric lens 10 and the radome 11 with an adhesive agent having a low dielectric constant fills in the small gap between both with adhesives. Alternatively, it may be sufficient simply to bring the dielectric lens and the radome into close contact, without using adhesives or the like.

This configuration prevents dust, rain, and snow from adhering to the recessed portion of the dielectric lens 10, whereby the degradation factor of antenna properties can be eliminated when configuring the dielectric lens antenna 12.

FIG. 23 illustrate the result of having obtained light rays (electromagnetic waves) exiting in the direction of the surface of the dielectric lens 10 from a focal point using the ray tracing method regarding the case of providing the above radome 11 and the case of not providing the radome 11.

Figure 23B:
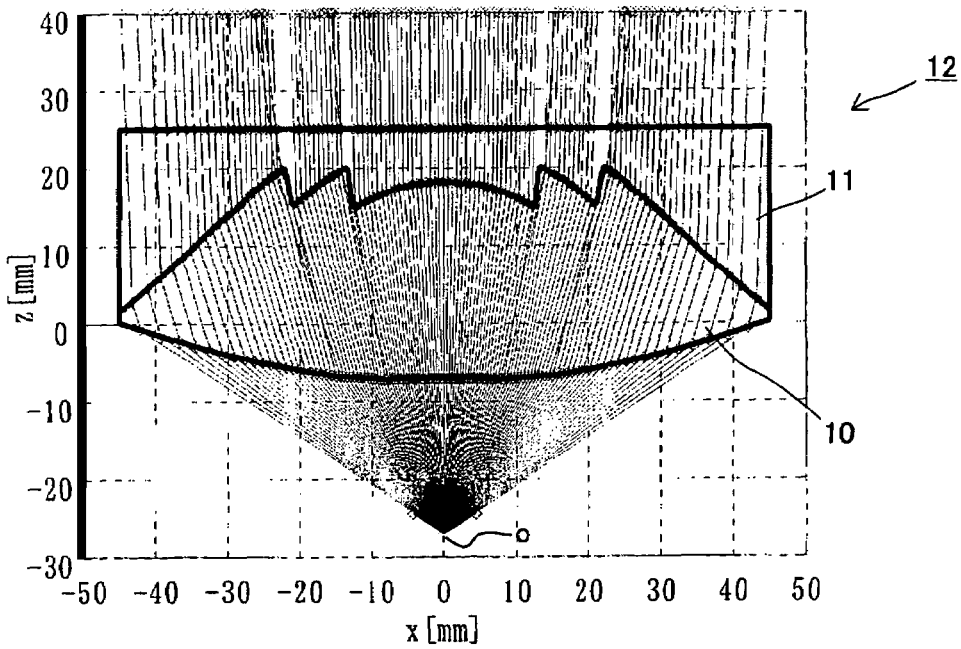

Since the specific inductive capacity (1.1) of the radome 11 is generally equal to the specific inductive capacity (1.0) of the surrounding air, there is practically no adverse influence on refraction at the interface of the front-side refraction face of the dielectric lens 10 and the radome 11. Accordingly, as shown in FIG. 23B, there is almost no disorder of the light ray of the dielectric lens device 12 which consists of the dielectric lens 10 and the radome 11, and the light exiting from the dielectric lens device 12 is almost the same parallel light as the case of the dielectric lens 10 alone.

As a result, the antenna gain of the dielectric lens antenna configured without providing the radome 11 was 34 dBi, but the antenna gain of the dielectric lens antenna configured of the dielectric lens device 12 provided with the radome 11 was 33 dBi. This shows that deterioration of antenna gain is of a negligible level.

Note that an arrangement may be made wherein the specific inductive capacity of the medium of the exterior on the front side of the dielectric lens 10 is also used for the specific inductive capacity of the radome 11 and the simultaneous equations of Expression 1 through Expression 3 are solved, whereby the shape of a dielectric lens is designed. Thus, the light which passes through the inside of the radome 11 becomes parallel light. As shown in FIGS. 22 and 23, since parallel light passes through the interface between the surface of this radome 11 and the air, refraction which changes directivity is not produced at the interface of this radome 11 and air, since the front side of the radome 11 has been formed as a plane. Accordingly, problems such as antenna gain of the dielectric lens antenna properties deteriorating do not arise, due to having added the radome 11.

Figure 24:
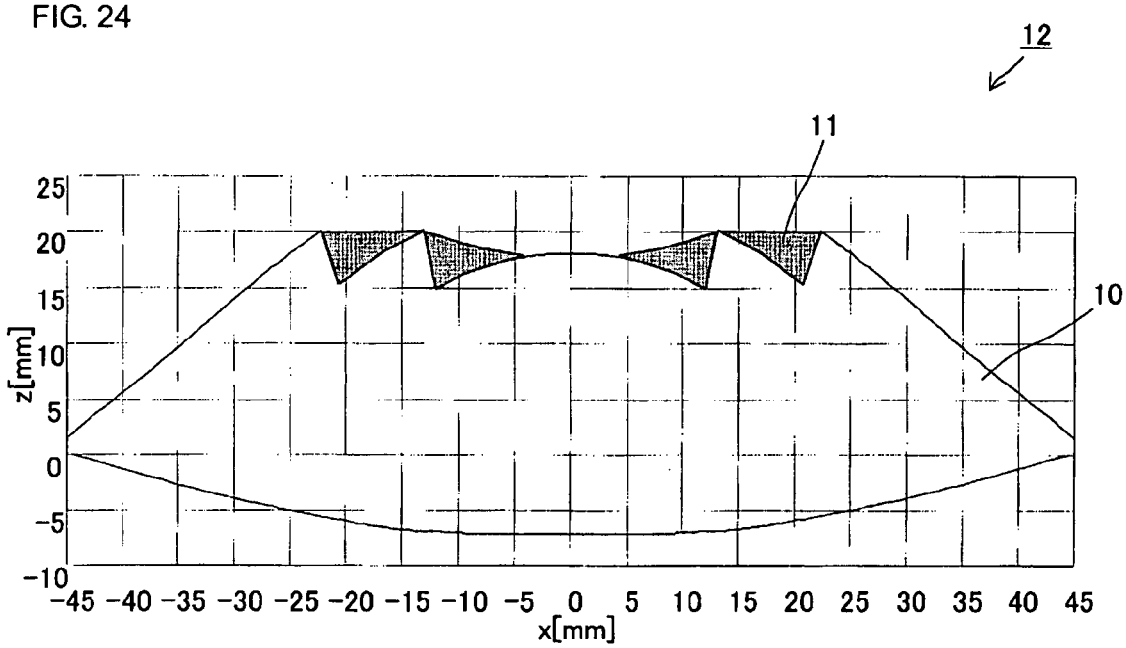
FIG. 24 is a diagram illustrating the configuration of a dielectric lens device according to a tenth embodiment.

FIG. 24 is a cross-sectional view of a dielectric lens device according to a tenth embodiment. With this example, the radome 11 is provided only in the recessed portion of the surface side of the dielectric lens 10. Specifically, the radome 11 is formed of foaming material by filling the recessed portion of the dielectric lens 10 with the foaming material of specific inductive capacity of 1.1.

Since the specific inductive capacity of the radome 11 is sufficiently smaller than the specific inductive capacity of the dielectric lens 10 and also close to the specific inductive capacity of air, the light which passes through from the dielectric lens 10 and the radome 11 to the front side remains generally parallel light. Therefore, the problem of the antenna gain of the dielectric lens antenna deteriorating is not caused by having provided the radome 11.

Since the volume of the radome which covers the surface of the dielectric lens 10 is minimal with such a configuration, disorder of light rays decreases further and property degradation of the dielectric lens antenna is further suppressed. Moreover, the entire dielectric lens device 12 can be formed thinly.

Figure 25A:
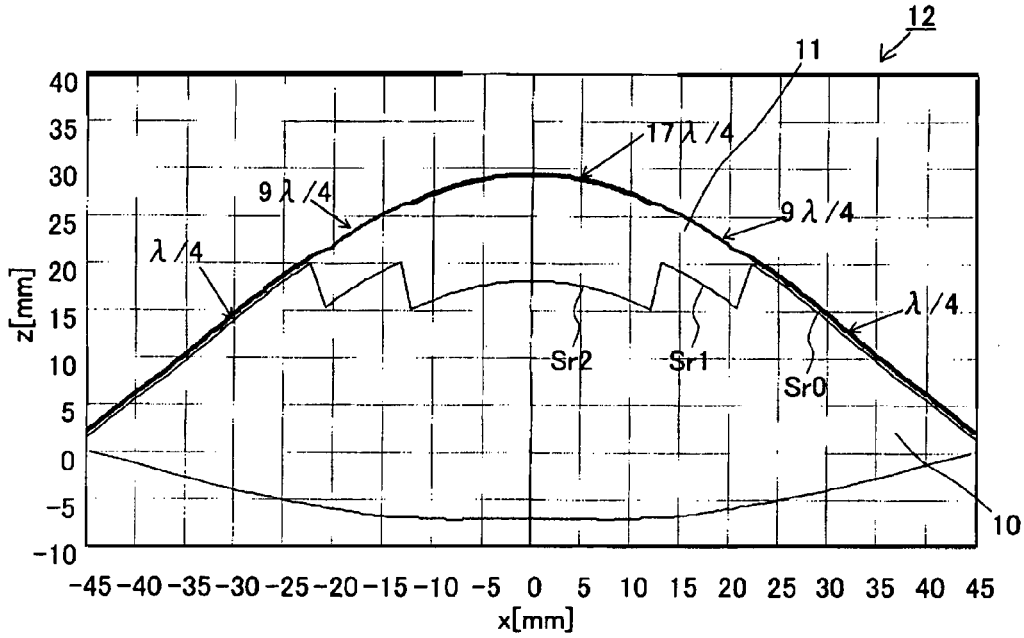
FIGS. 25A and 25B are diagrams illustrating the configuration and design method of a dielectric lens device according to an eleventh embodiment.
Figure 25B:
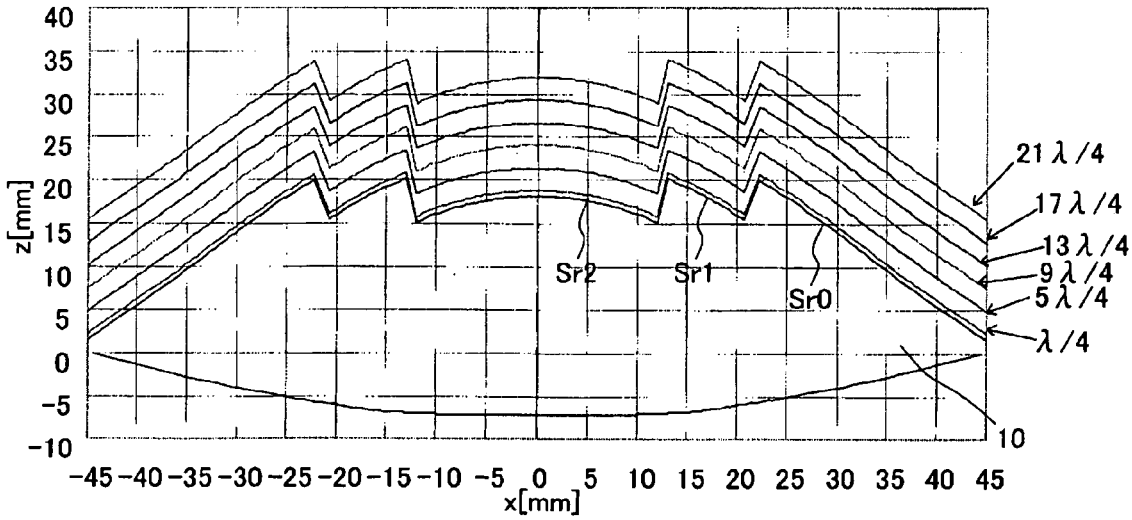

FIG. 25A is a diagram illustrating the configuration of a dielectric lens device according to an eleventh embodiment. FIG. 25B shows the design process of the surface shape of the radome 11.

Here, with n as an integer of 0 or greater and λ as the wavelength within the radome 11, the surface shape of the radome 11 is determined such that the front face of the radome 11 is just λ/4+n λ from the front face of the dielectric lens 10.

Multiple lines drawn along the surface of the dielectric lens 10 shown in FIG. 25B show the surface position which the radome 11 can assume. The portion close to the front-side refraction face Sr0 of the portion of the dielectric lens 10 which has not been subjected to zoning, takes the position just λ/4 from the front face as the front face of the radome 11. As for the front-side refraction faces Sr1 and Sr2 serving as the portions of the dielectric lens 10 which have been subjected to zoning, n is determined so as to be just λ/4+n λ from the surface of the dielectric lens 10, and that steps do not occur if possible on the radome 11 front face. With this example of FIG. 25A, the portion close to the front-side refraction face Sr1 is set to λ/4+2 λ (=9 λ/4), and the portion close to front-side refraction face Sr2 is set to λ/4+4 λ (=17 λ/4). Discontinuous portions are connected with a cone face (a straight line in a cross-section) or a curved face (a curve in a cross-section).

Thus, by designing the thickness of each part of the radome, reflection at the dielectric lens 10 surface and reflection at the radome 11 surface are compounded by the reverse phase on the radome surface, and reflected light is cancelled out. As a result, reflection at the surface of dielectric lens device 12 is suppressed to a low level.

Also, the specific inductive capacity of the radome 11 is selected so as to have a relation of $\epsilon 2=\sqrt{(\epsilon 1)}$, with the specific inductive capacity of the dielectric lens 10 represented with $\epsilon 1$ and the specific inductive capacity of the radome 11 represented with $\epsilon 2$. For example, when the specific inductive capacity $\epsilon 1$ of the dielectric lens 10 is 3.1, $\epsilon 2=\sqrt{(3.1)}$ approximately equals 1.76, so the radome 11 is configured with a resin material having specific inductive capacity of around 1.76.

Since the intensity of the reflected light on the dielectric lens 10 surface and the intensity of the reflected light on the radome 11 surface match, the above-mentioned cancellation effect is maximal, and the greatest low-reflective properties are obtained.

Note that when the surface shape of the radome is designed such that steps do not occur as much as possible as shown in FIG. 25, the thickness of the entire dielectric lens device increases again despite having formed the dielectric lens in a thin shape by zoning. However, the low reflective properties are acquired as mentioned above as compared with the case in which the single dielectric lens which is not subjected to zoning is employed. Moreover, the specific inductive capacity of the radome 11 is a low dielectric constant and is low specific gravity as compared with the dielectric lens 10, thereby realizing overall reduction in weight.

Figure 26:
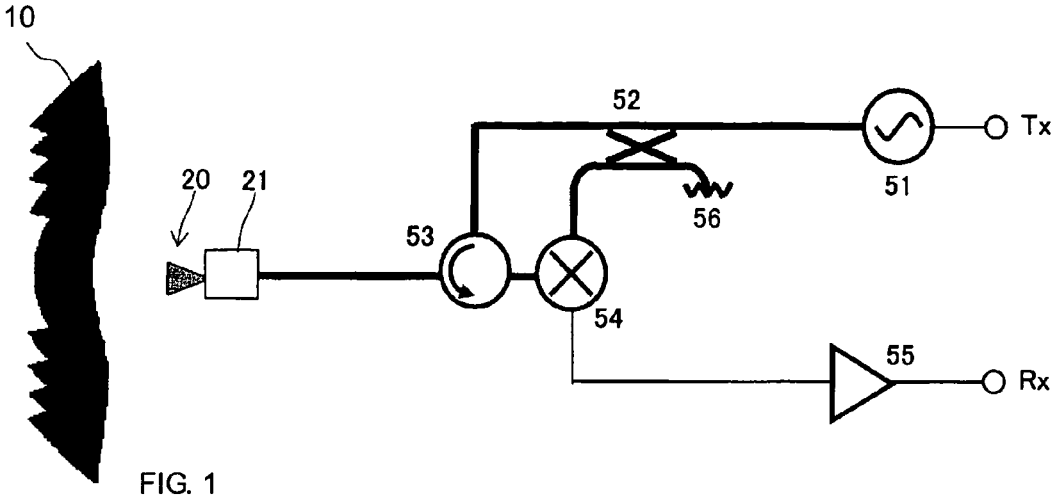
FIG. 26 is a diagram illustrating the configuration of a millimeter wave radar according to a twelfth embodiment.
Figure 1:
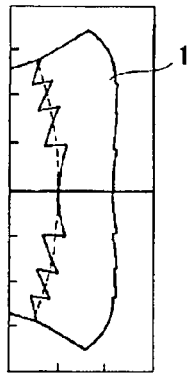
FIG. 1 is a diagram illustrating the configuration of a dielectric lens subjected to conventional zoning.
Figure 3:
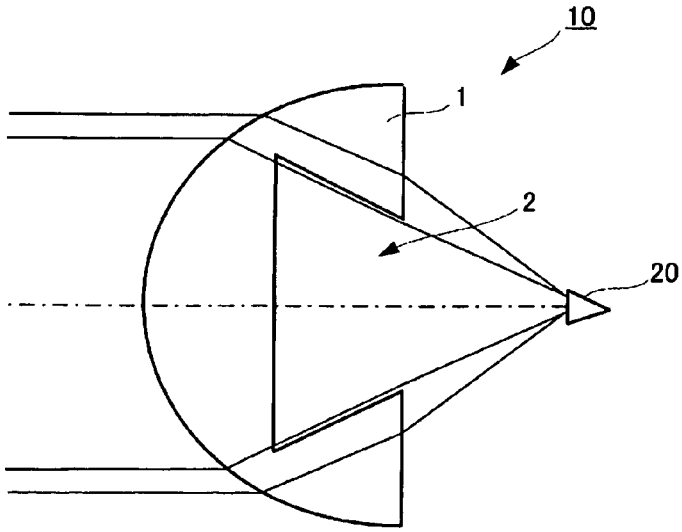
FIG. 3 is a diagram illustrating the configuration of another dielectric lens subjected to conventional zoning.
Figure 2:
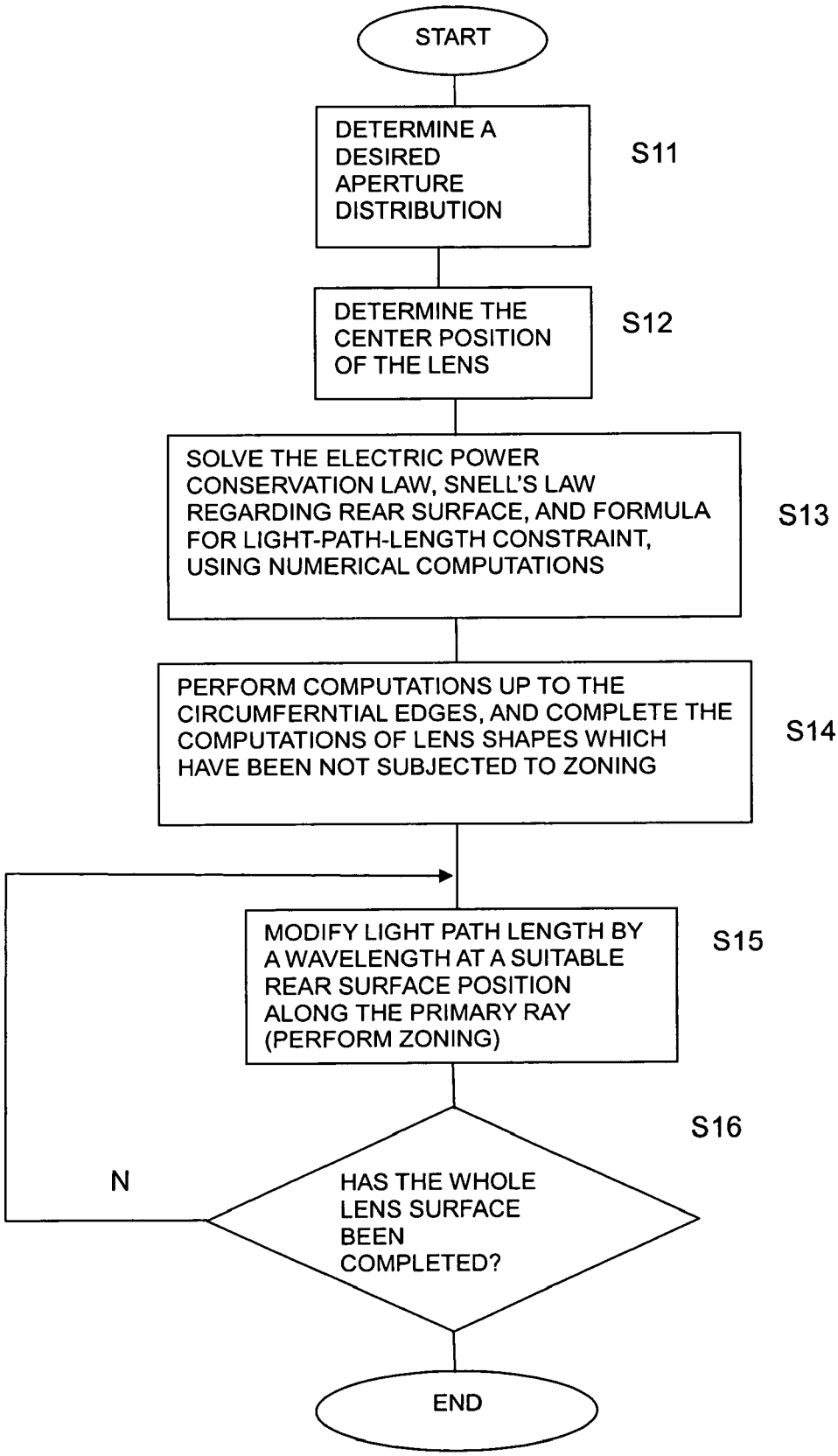
FIG. 2 is a flowchart illustrating the design procedures of the dielectric lens in FIG. 1.
Figure 4A:
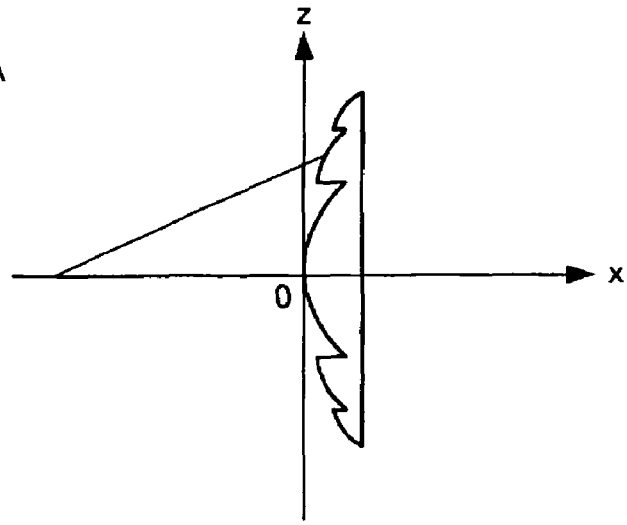
FIGS. 4A to 4C are diagrams illustrating the configuration of other dielectric lens as subjected to conventional zoning.
Figure 4B:
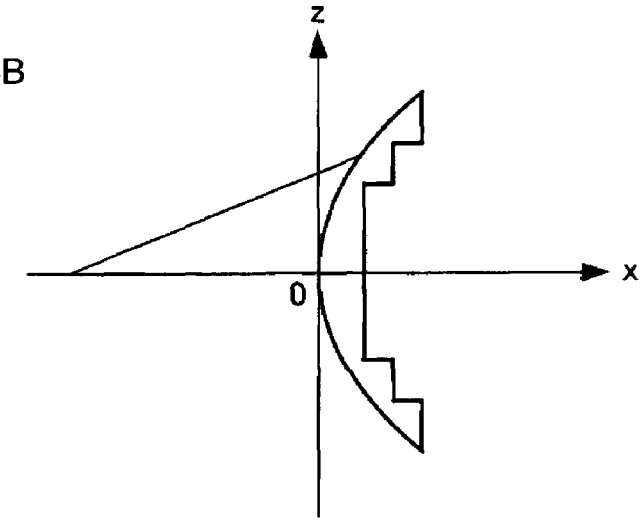
Figure 4C:
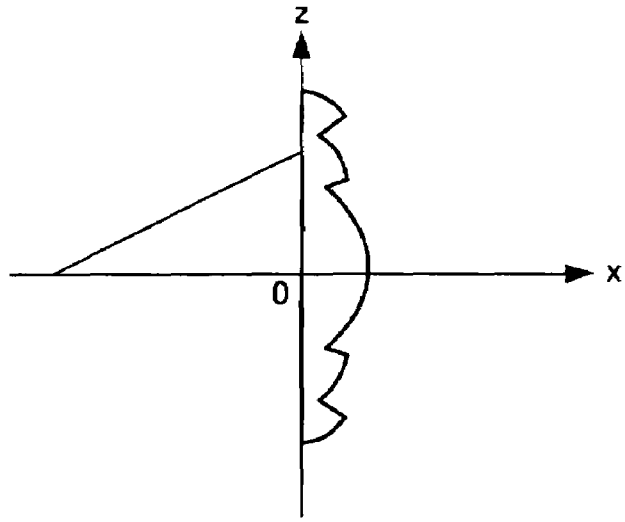

FIG. 26 is a block diagram illustrating the configuration of a millimeter wave radar according to a twelfth embodiment. In FIG. 26, VCO51 is a voltage-controlled oscillator which employs a Gunn diode or FET, and a varactor diode, and so forth, which modulates an oscillation signal with a transmitted signal Tx, and gives the modulation signal (transmitted signal) to an Lo branch coupler 52 via an NRD guide. The Lo branch coupler 52 is a coupler which consists of an NRD guide which takes out a part of the transmitted signal as a local signal, a directional coupler being configured of this Lo branch coupler 52 and a termination 56. A circulator 53 is an NRD guide circulator, and gives the transmitted signal to the primary radiator 20 of a dielectric lens antenna, and transmits the received signal from the primary radiator 20 to a mixer 54. The primary radiator 20 and the dielectric lens 10 make up the dielectric lens antenna. The mixer 54 mixes the received signal from the circulator 53, and the above-mentioned local signal, and outputs the received signal of an intermediate frequency. An LNA 55 subjects the received signal from the mixer 54 to low noise amplification, and outputs this as a received signal Rx. The signal-processing circuit outside the drawing controls a primary radiator moving mechanism 21, and also detects the distance to a target and relative velocity from the relation between the modulation signal Tx of the VCO and the Rx signal. Note that as for a transmission line, a wave guide tube or MSL may be employed other than the above-mentioned NRD guide.

INDUSTRIAL APPLICABILITY

The present invention is applicable to a dielectric lens antenna which transmits and receives electromagnetic waves of a microwave band or a millimeter wave band.

The invention claimed is:

1. A design method of a dielectric lens having a front face on the radiator side of the dielectric lens and a rear face on the non-radiator side of the dielectric lens comprising:

(a) determining a desired aperture distribution;

(b) converting Snell's law at the rear face, electric power conservation law, and the formula representing light-path-length constraint, into simultaneous equations, and computing the shapes of the front face and rear face surfaces at the azimuthal angle θ of a primary ray from the focal point of the dielectric lens to the rear face of the dielectric lens; and (c) reducing the light path length in said formula showing light-path-length constraint by an integral multiple of the wavelength in the air when the coordinates on the surface of the dielectric lens reach a predetermined restriction thickness position;

repeating (b) and (c) at least once;

wherein said azimuthal angle θ of a primary ray is changed from its initial value.

2. The design method of a dielectric lens according to claim 1, further comprising correcting the inclination angle of the stepped face occurring on the front side surface by reducing said light path length only by the integral multiple of the wavelength such that said stepped face inclines toward the focal direction rather than the thickness direction of the dielectric lens, and then repeating (b) and (c) until said azimuthal angle θ reaches a final value.

3. The design method of a dielectric lens according to claim 2, wherein the angle which said stepped face forms as to the primary ray of electromagnetic waves which enters into an arbitrary position of the rear face of the dielectric lens from said focal point, is refracted and progresses within the dielectric lens, is within the limits of ±20°.

4. The design method of a dielectric lens according to claim 3, wherein the initial value of said azimuthal angle θ is the angle which the primary ray forms from said focal point to the surrounding end positions of the dielectric lens, and the final value of said azimuthal angle θ is the angle which the primary ray forms from said focal point to the optical axis of the dielectric lens.

5. The design method of a dielectric lens according to claim 1, wherein the initial value of said azimuthal angle θ is the angle which the primary ray forms from said focal point to the surrounding end positions of the dielectric lens, and the final value of said azimuthal angle θ is the angle which the primary ray forms from said focal point to the optical axis of the dielectric lens.

6. A manufacturing method of a dielectric lens comprising:

designing the shape of a dielectric lens using the design method of a dielectric lens according to claim 1;

preparing an injection-molding mold; and injecting resin in said injection-molding mold to create a dielectric lens with the resin.

7. A manufacturing method of a dielectric lens comprising:

designing the shape of a dielectric lens using the design method of a dielectric lens according to claim 3;

preparing an injection-molding mold; and injecting resin in said injection-molding mold to create a dielectric lens with the resin.

8. A dielectric lens of which the principal portion forms a rotationally symmetrical member with the optical axis as a rotation center, and a front-side surface opposite to a primary radiator comprising:

multiple front-side refraction faces which protrude from the front-side surface; and a stepped face which connects adjoining front-side refraction faces;

wherein the stepped face forms an angle within the limits of ±20°to the primary ray which enters into an arbitrary position of a rear face which faces said primary radiator from a focal point, and progresses within the lens, and a curved face by zoning is provided in the position in said rear face of the primary ray passing through said front-side refraction face.

9. A dielectric lens of which the principal portion forms a rotationally symmetrical member with the optical axis as a rotation center, and a front-side surface opposite to a primary radiator comprising:

multiple front-side refraction faces which protrude from the front-side surface; and a stepped face which connects adjoining front-side refraction faces:

wherein the stepped face forms within the limits of ±20°to the primary ray which enters into an arbitrary position of a rear face which faces said primary radiator from a focal point, and progresses within the lens, and a curved face by zoning is provided in the position in said rear face of the primary ray passing through said front-side refraction face, and wherein the curved face by zoning between said front-side refraction face and said rear face is a curved face obtained by Snell's law regarding the rear face, light-path-length conditions, and the electric power conservation law which provides a desired aperture distribution.

10. A dielectric lens device comprising:

a dielectric lens according to claim 9; and a radome on the surface of the dielectric lens having a configuration which fills the recessed portion formed by said front-side refraction face and said stepped face, and wherein the radome has a dielectric constant lower than that of said dielectric lens.

11. The dielectric lens device according to claim 10, wherein when representing the specific inductive capacity of said radome as ϵ2, and representing the specific inductive capacity of said dielectric lens as ϵ1 respectively, ϵ2 . . . (ϵ1 ) is satisfied.

12. The dielectric lens device according to claim 11, wherein a face of said radome connects multiple curved faces at a distance from the surface of said dielectric lens by λ/4+nλ wherein n is an integer equal to or greater than 0, and λ is a wavelength.

13. A dielectric lens device comprising:

a dielectric lens according to claim 8; and a radome on the surface of the dielectric lens having a configuration which fills the recessed portion formed by said front-side refraction face and said stepped face, and wherein the radome has a dielectric constant lower than that of said dielectric lens.

14. The dielectric lens device according to claim 13, wherein when representing the specific inductive capacity of said radome as ϵ2, and representing the specific inductive capacity of said dielectric lens as ϵ1 respectively, ϵ2 . . . (ϵ1 ) is satisfied.

15. The dielectric lens device according to claim 14, wherein a face of said radome connects multiple curved faces at a distance from the surface of said dielectric lens by λ/4+nλ wherein n is an integer equal to or greater than 0, and λ is a wavelength.

16. Transceiving equipment comprising: a dielectric lens according to claim 8; and a primary radiator.

17. Transceiving equipment comprising: a dielectric lens according to claim 9; and a primary radiator.

18. Transceiving equipment comprising: a dielectric lens device according to claim 10; and a primary radiator.

19. Transceiving equipment comprising: a dielectric lens device according to claim 11; and a primary radiator.

20. Transceiving equipment comprising: a dielectric lens device according to claim 12; and a primary radiator.

* * * * *